US008616892B2

(12) United States Patent
Morag et al.

(10) Patent No.: US 8,616,892 B2
(45) Date of Patent: Dec. 31, 2013

(54) TRAINING SYSTEM FOR AN ARTICLE OF FOOTWEAR WITH A TRACTION SYSTEM

(75) Inventors: Erez Morag, Lake Oswego, OR (US); Perry W. Auger, Tigard, OR (US); Sergio Cavaliere, Venice (IT)

(73) Assignee: Nike, Inc., Beaverton, OR (US)

( * ) Notice: Subject to any disclaimer, the term of this patent is extended or adjusted under 35 U.S.C. 154(b) by 561 days.

(21) Appl. No.: 12/824,768

(22) Filed: Jun. 28, 2010

(65) Prior Publication Data

US 2011/0045926 A1 Feb. 24, 2011

Related U.S. Application Data

(63) Continuation-in-part of application No. 12/752,318, filed on Apr. 1, 2010, now Pat. No. 8,453,349.

(60) Provisional application No. 61/166,191, filed on Apr. 2, 2009.

(51) Int. Cl.
*G09B 19/00* (2006.01)

(52) U.S. Cl.
USPC ..... 434/251

(58) Field of Classification Search
USPC ..... 434/251
See application file for complete search history.

(56) References Cited

U.S. PATENT DOCUMENTS

| | | | |
|---|---|---|---|
| D15,185 | S | 8/1884 | Brooks |
| 830,324 | A | 9/1906 | Hunt |
| 950,333 | A | 2/1910 | Koch |
| 1,087,212 | A | 2/1914 | Caldwell |
| 1,184,013 | A | 5/1916 | Pierce |
| 1,361,078 | A | 12/1920 | Lynn |
| 1,469,766 | A | 10/1923 | Blair |
| 1,559,114 | A | 10/1925 | Maranville |
| D81,917 | S | 9/1930 | Burchfield |
| 2,087,945 | A | 7/1937 | Butler |
| 2,095,095 | A | 10/1937 | Howard |
| 2,185,397 | A | 1/1940 | Birchfield |
| 2,187,430 | A | 1/1940 | Olmsted et al. |
| 2,350,879 | A | 6/1944 | Daniels |
| D171,130 | S | 12/1953 | Gruner |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

Invitation to Pay Additional Fees and, Where Applicable, Protest Fee mailed Jan. 7, 2013 in International Application No. PCT/US2012/052968.

(Continued)

*Primary Examiner* — Kurt Fernstrom
*Assistant Examiner* — Dolores Collins
(74) *Attorney, Agent, or Firm* — Plumsea Law Group, LLC

(57) ABSTRACT

A training system for an article of footwear is disclosed. The training system includes a method of training an athlete to use an article of footwear with a traction system to help enhance speed and agility. The method can be implemented on a computer, mobile device or as an instruction booklet. The training system provides a total training solution for an athlete that is designed to enhance specific athletic skills.

20 Claims, 16 Drawing Sheets

(56) References Cited

U.S. PATENT DOCUMENTS 2,918,734 A 12/1959 Hyde
2,941,527 A 6/1960 Scholl
2,969,062 A 1/1961 Landau
3,043,026 A 7/1962 Semon
3,063,171 A 11/1962 Hollander
3,063,555 A 11/1962 Hanington
3,091,871 A * 6/1963 Tronche ..... 36/72 R
D201,865 S 8/1965 Bingham, Jr. et al.
3,253,591 A 5/1966 Scholl
3,325,919 A 6/1967 Robinson
3,328,901 A 7/1967 Strickland
3,341,952 A 9/1967 Dassler
3,352,034 A 11/1967 Braun
3,419,974 A 1/1969 Lange
D213,416 S 3/1969 Dittmar et al.
3,481,820 A 12/1969 Jonas
D219,503 S 12/1970 Vietas
3,548,420 A 12/1970 Spence
3,597,863 A 8/1971 Austin et al.
3,619,916 A 11/1971 Neri
3,631,614 A 1/1972 Rice
3,649,967 A 3/1972 Millman
3,656,245 A 4/1972 Wilson
3,668,793 A 6/1972 Stohr et al.
3,693,270 A 9/1972 Murray
3,703,775 A 11/1972 Gatti
3,775,874 A 12/1973 Bonneville
3,858,337 A 1/1975 Vogel
3,951,407 A 4/1976 Calacurcio
4,065,861 A 1/1978 Pelfrey
4,084,265 A 4/1978 Anfelt
4,096,649 A 6/1978 Saurwein
4,107,858 A 8/1978 Bowerman et al.
4,146,979 A 4/1979 Fabbrie
4,204,346 A 5/1980 Fugere
4,210,245 A 7/1980 Dodge
4,245,406 A 1/1981 Landay et al.
4,315,374 A 2/1982 Sneeringer
4,335,530 A 6/1982 Stubblefield
4,342,159 A 8/1982 Edwards
4,347,674 A 9/1982 George
4,375,728 A 3/1983 Dassler
4,375,729 A 3/1983 Buchanen, III
4,385,456 A 5/1983 Livernois et al.
4,392,312 A 7/1983 Crowley et al.
D271,159 S 11/1983 Muller-Feigelstock
D272,200 S 1/1984 Autry et al.
4,428,089 A 1/1984 Dawber et al.
D272,772 S 2/1984 Kohno
4,452,289 A 6/1984 Smith
4,454,662 A 6/1984 Stubblefield
D278,759 S 5/1985 Norton et al.
4,534,122 A 8/1985 MacPhail
4,574,498 A 3/1986 Norton et al.
4,577,625 A 3/1986 Lohati et al.
4,586,274 A 5/1986 Blair
D287,662 S 1/1987 Tonkel
4,633,600 A 1/1987 Dassler et al.
4,667,425 A 5/1987 Effler et al.
4,674,200 A 6/1987 Sing
4,689,901 A 9/1987 Ihlenburg
4,698,923 A 10/1987 Arff
4,703,445 A 10/1987 Dassler
4,715,133 A 12/1987 Hartjes et al.
4,726,126 A 2/1988 Bernhard
D294,655 S 3/1988 Heyes
D295,231 S 4/1988 Heyes
4,771,394 A 9/1988 Cavanagh
4,819,795 A 4/1989 Swaney
4,825,552 A 5/1989 Bendickson et al.
4,833,796 A 5/1989 Flemming
4,858,343 A 8/1989 Flemming
4,873,774 A 10/1989 Lafever
4,893,519 A 1/1990 Corso et al.
4,951,533 A 8/1990 Hillinger
5,025,573 A 6/1991 Giese et al.
5,056,945 A 10/1991 Klodt
D323,217 S 1/1992 Holden
5,092,347 A 3/1992 Shaffer et al.
5,174,049 A 12/1992 Flemming
5,201,126 A 4/1993 Tanel
5,203,793 A 4/1993 Lyden
5,216,827 A 6/1993 Cohen
5,221,379 A 6/1993 Nicholas
D339,459 S 9/1993 Yoshikawa et al.
5,289,647 A 3/1994 Mercer
5,299,369 A 4/1994 Goldman
D347,709 S 6/1994 Pearson
5,335,429 A 8/1994 Hansen
5,339,544 A 8/1994 Caberlotto
5,343,445 A 8/1994 Cherdak
5,351,422 A 10/1994 Fitzgerald
5,367,791 A 11/1994 Gross et al.
5,383,290 A 1/1995 Grim
5,384,973 A 1/1995 Lyden
5,392,534 A 2/1995 Grim
5,406,723 A 4/1995 Okajima
5,410,823 A 5/1995 Lyoob
5,419,014 A 5/1995 Piantedosi
5,433,437 A 7/1995 Dudley
5,452,269 A 9/1995 Cherdak
5,452,526 A 9/1995 Collins
5,461,801 A 10/1995 Anderton
5,473,827 A 12/1995 Barre et al.
5,491,015 A 2/1996 Reeves et al.
D368,156 S 3/1996 Longbottom et al.
5,500,956 A 3/1996 Schulkin et al.
D368,360 S 4/1996 Wolfe
D369,672 S 5/1996 Tanaka et al.
5,513,451 A 5/1996 Kataoka et al.
5,524,637 A 6/1996 Erickson
5,526,589 A 6/1996 Jordan
5,530,626 A 6/1996 Norment
5,555,650 A 9/1996 Longbottom et al.
5,572,739 A 11/1996 Kolada et al.
5,572,807 A 11/1996 Kelly et al.
5,592,759 A 1/1997 Cox
5,617,650 A 4/1997 Grim
5,617,653 A 4/1997 Walker et al.
5,629,186 A 5/1997 Yasukawa et al.
5,634,283 A 6/1997 Kastner
5,634,284 A 6/1997 MacPhail
5,669,833 A * 9/1997 Stone ..... 473/422
D387,892 S 12/1997 Briant
5,692,322 A 12/1997 Lombardino
D389,298 S 1/1998 Briant
5,709,954 A 1/1998 Lyden et al.
5,737,858 A * 4/1998 Levy ..... 36/128
5,740,618 A 4/1998 Minden
D394,943 S 6/1998 Campbell et al.
5,766,704 A 6/1998 Allen et al.
5,775,010 A 7/1998 Kaneko
5,806,209 A 9/1998 Crowley et al.
5,815,951 A 10/1998 Jordan
5,827,459 A 10/1998 Allen et al.
5,832,636 A 11/1998 Lyden et al.
5,878,378 A 3/1999 Brommer et al.
5,882,205 A * 3/1999 Peterson ..... 434/251
5,887,371 A 3/1999 Curley, Jr.
5,897,446 A 4/1999 Wiseman et al.
5,929,332 A 7/1999 Brown
5,939,157 A 8/1999 Allen et al.
5,946,828 A 9/1999 Jordan et al.
5,947,845 A 9/1999 Canelas
5,955,159 A 9/1999 Allen et al.
5,956,871 A 9/1999 Korsen
D415,340 S 10/1999 McMullin
5,979,083 A 11/1999 Robinson et al.
5,983,529 A 11/1999 Serna
5,985,383 A 11/1999 Allen et al.
5,987,783 A 11/1999 Allen et al.
6,016,613 A 1/2000 Campbell et al.
D421,833 S 3/2000 Fallon
6,035,559 A 3/2000 Freed et al.

(56) References Cited

U.S. PATENT DOCUMENTS 6,079,127 A 6/2000 Nishimura et al.
D427,754 S 7/2000 Portaud
6,099,936 A 8/2000 Kashihara
6,101,746 A 8/2000 Evans
6,112,433 A 9/2000 Greiner
6,125,556 A 10/2000 Peckler et al.
6,145,221 A 11/2000 Hockerson
6,161,315 A 12/2000 Dalton
D437,108 S 2/2001 Peabody
D437,989 S 2/2001 Cass
6,195,917 B1 3/2001 Dieckhaus
6,199,303 B1 3/2001 Luthi et al.
6,213,298 B1 4/2001 Nguyen
6,231,946 B1 5/2001 Brown, Jr. et al.
6,256,907 B1 7/2001 Jordan et al.
6,270,432 B1 8/2001 Matlock
6,312,361 B1 11/2001 Hayes
6,315,571 B1 11/2001 Lee
6,357,146 B1 3/2002 Wordsworth et al.
6,389,714 B1 5/2002 Mack
6,405,606 B1 6/2002 Walczyk et al.
6,408,542 B1 6/2002 Shepherd
D461,297 S 8/2002 Lancon
6,442,875 B1 9/2002 Joubert et al.
6,481,122 B2 11/2002 Brahler
D468,517 S 1/2003 Recchi et al.
6,523,282 B1 2/2003 Johnston
6,543,158 B2 4/2003 Dieckhaus
6,550,160 B2 4/2003 Miller, II
D477,905 S 8/2003 Adams et al.
D478,714 S 8/2003 Recchi
6,618,962 B1 9/2003 Covatch
6,647,549 B2 11/2003 McDevitt et al.
6,647,647 B2 11/2003 Auger et al.
6,671,981 B2 1/2004 Brooks
6,675,505 B2 1/2004 Terashima
6,698,110 B1 3/2004 Robbins
6,708,427 B2 3/2004 Sussmann et al.
6,725,574 B2 4/2004 Hokkirigawa et al.
6,739,075 B2 5/2004 Sizemore
6,754,984 B2 6/2004 Schaudt et al.
D495,122 S 8/2004 McMullin
6,808,462 B2 10/2004 Snyder et al.
6,834,446 B2 12/2004 McMullin
6,892,479 B2 5/2005 Auger et al.
6,904,707 B2 6/2005 McMullin
6,915,595 B2 7/2005 Kastner
6,915,596 B2 7/2005 Grove et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
7,028,419 B2 4/2006 Brooks
D525,416 S 7/2006 Auger et al.
7,143,530 B2 12/2006 Hudson et al.
7,155,846 B2 1/2007 Alfaro et al.
7,172,521 B1 2/2007 Novis
7,181,868 B2 2/2007 Auger et al.
7,188,439 B2 3/2007 DiBenedetto et al.
7,194,826 B2 3/2007 Ungari
7,234,250 B2 6/2007 Fogarty et al.
7,241,234 B2 7/2007 Eite
7,254,909 B2 8/2007 Ungari
7,269,916 B2 9/2007 Biancucci et al.
7,287,343 B2 10/2007 Healy
7,292,867 B2 11/2007 Werner et al.
7,329,448 B2 2/2008 Cunningham
7,355,519 B2 4/2008 Grold et al.
7,370,439 B1 5/2008 Myers
D571,092 S 6/2008 Norton
D571,542 S 6/2008 Wilken
7,386,948 B2 6/2008 Sink
D573,779 S 7/2008 Stauffer
7,401,418 B2 7/2008 Wyszynski et al.
D575,041 S 8/2008 Wilken
7,406,781 B2 8/2008 Scholz
7,409,783 B2 8/2008 Chang
D578,280 S 10/2008 Wilken
7,430,819 B2 10/2008 Auger et al.
7,441,350 B2 10/2008 Auger et al.
7,490,418 B2 2/2009 Obeydani
7,497,035 B2 * 3/2009 Kos et al. ..... 36/133
7,536,810 B2 5/2009 Jau et al.
7,559,160 B2 7/2009 Kelly
7,575,433 B2 8/2009 Shibata et al.
7,579,946 B2 8/2009 Case, Jr.
7,581,643 B2 9/2009 Wilskey et al.
7,584,554 B2 9/2009 Fogarty et al.
7,596,891 B2 10/2009 Carnes et al.
7,650,707 B2 1/2010 Campbell et al.
D609,436 S 2/2010 Flint
7,654,013 B2 2/2010 Savoie et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,707,748 B2 5/2010 Campbell
7,727,608 B2 6/2010 Cunningham
7,762,009 B2 7/2010 Gerber
7,784,196 B1 8/2010 Christensen et al.
7,866,064 B2 1/2011 Gerber
D632,466 S 2/2011 Kasprzak
7,941,943 B2 5/2011 Baker et al.
7,942,784 B1 5/2011 Hyde et al.
7,984,569 B2 7/2011 Chaney et al.
7,997,007 B2 8/2011 Sanabria-Hernandez
8,043,173 B2 10/2011 Menalagha et al.
8,079,160 B2 12/2011 Baucom et al.
8,122,617 B1 2/2012 Dixon et al.
8,196,321 B2 * 6/2012 Baker et al. ..... 36/133
8,196,322 B2 * 6/2012 Atsumi et al. ..... 36/133
8,246,494 B2 * 8/2012 Stephenson ..... 473/446
8,251,207 B2 8/2012 Baker et al.
8,256,145 B2 9/2012 Baucom et al.
8,257,228 B2 9/2012 Quatrochi et al.
8,262,515 B2 * 9/2012 Morris ..... 473/420
8,286,619 B2 * 10/2012 Mihaljevic ..... 124/16
2001/0022039 A1 9/2001 Krajcir
2002/0017036 A1 2/2002 Berger et al.
2002/0029496 A1 3/2002 Morle
2002/0078603 A1 6/2002 Schmitt, Jr.
2002/0100190 A1 8/2002 Pellerin
2002/0178619 A1 12/2002 Schaudt et al.
2003/0033731 A1 2/2003 Sizemore
2003/0188458 A1 10/2003 Kelly
2004/0000075 A1 1/2004 Auger et al.
2004/0035024 A1 2/2004 Kao
2004/0046692 A1 3/2004 Robson et al.
2004/0088888 A1 5/2004 Johnston
2004/0187356 A1 9/2004 Patton
2004/0250451 A1 12/2004 McMullin
2005/0016023 A1 1/2005 Burris
2005/0016029 A1 1/2005 Auger et al.
2005/0072026 A1 4/2005 Sink
2005/0097783 A1 5/2005 Mills et al.
2005/0108898 A1 5/2005 Jeppesen et al.
2005/0120593 A1 6/2005 Mason
2005/0144812 A1 7/2005 Wheeler
2005/0217149 A1 10/2005 Ho
2005/0221919 A1 10/2005 Eite
2005/0257405 A1 11/2005 Kilgore
2005/0268490 A1 12/2005 Foxen
2006/0016101 A1 1/2006 Ungari
2006/0021254 A1 2/2006 Jones
2006/0021255 A1 2/2006 Auger et al.
2006/0026528 A1 2/2006 Paulsen et al.
2006/0042124 A1 3/2006 Mills et al.
2006/0130372 A1 6/2006 Auger et al.
2006/0218821 A1 * 10/2006 Hatzilias ..... 36/133
2006/0242863 A1 11/2006 Patmore
2007/0039209 A1 2/2007 White et al.

(56) References Cited

U.S. PATENT DOCUMENTS

| | | | | |
|---|---|---|---|---|
| 2007/0199211 | A1 | 8/2007 | Campbell | |
| 2007/0199213 | A1 | 8/2007 | Campbell et al. | |
| 2007/0227047 | A1* | 10/2007 | Zaza | 36/133 |
| 2007/0261271 | A1 | 11/2007 | Krouse | |
| 2007/0266597 | A1 | 11/2007 | Jones | |
| 2008/0009275 | A1 | 1/2008 | Werner et al. | |
| 2008/0010863 | A1 | 1/2008 | Auger et al. | |
| 2008/0059064 | A1 | 3/2008 | Werner et al. | |
| 2008/0066348 | A1 | 3/2008 | O'Brien et al. | |
| 2008/0098624 | A1 | 5/2008 | Goldman | |
| 2008/0127520 | A1 | 6/2008 | Luedecke et al. | |
| 2008/0196276 | A1 | 8/2008 | McMullin | |
| 2008/0214360 | A1 | 9/2008 | Stirling et al. | |
| 2008/0216352 | A1 | 9/2008 | Baucom et al. | |
| 2008/0218310 | A1 | 9/2008 | Alten et al. | |
| 2008/0293023 | A1* | 11/2008 | Diehl et al. | 434/248 |
| 2008/0319661 | A1 | 12/2008 | Werner et al. | |
| 2009/0019732 | A1 | 1/2009 | Sussmann | |
| 2009/0047645 | A1 | 2/2009 | Dibenedetto et al. | |
| 2009/0048044 | A1 | 2/2009 | Oleson et al. | |
| 2009/0048070 | A1 | 2/2009 | Vincent et al. | |
| 2009/0056169 | A1 | 3/2009 | Robinson, Jr. et al. | |
| 2009/0056172 | A1 | 3/2009 | Cho | |
| 2009/0077832 | A1 | 3/2009 | Flint | |
| 2009/0100711 | A1 | 4/2009 | Engel | |
| 2009/0100716 | A1 | 4/2009 | Gerber | |
| 2009/0100718 | A1 | 4/2009 | Gerber | |
| 2009/0113758 | A1 | 5/2009 | Nishiwaki et al. | |
| 2009/0113766 | A1 | 5/2009 | Hooper | |
| 2009/0124434 | A1 | 5/2009 | Abboud | |
| 2009/0126230 | A1 | 5/2009 | McDonald et al. | |
| 2009/0223088 | A1 | 9/2009 | Krikorian et al. | |
| 2009/0241370 | A1 | 10/2009 | Kimura | |
| 2009/0241377 | A1 | 10/2009 | Kita et al. | |
| 2009/0272008 | A1 | 11/2009 | Nomi et al. | |
| 2009/0284368 | A1 | 11/2009 | Case, Jr. | |
| 2009/0293315 | A1 | 12/2009 | Auger et al. | |
| 2009/0307933 | A1 | 12/2009 | Leach | |
| 2010/0050471 | A1 | 3/2010 | Kim | |
| 2010/0077635 | A1 | 4/2010 | Baucom et al. | |
| 2010/0083541 | A1 | 4/2010 | Baucom et al. | |
| 2010/0126044 | A1 | 5/2010 | Davis | |
| 2010/0199523 | A1 | 8/2010 | Mayden et al. | |
| 2010/0212190 | A1 | 8/2010 | Schmid | |
| 2010/0229427 | A1 | 9/2010 | Campbell et al. | |
| 2010/0251578 | A1 | 10/2010 | Auger et al. | |
| 2010/0275463 | A1 | 11/2010 | Gallagher | |
| 2010/0299961 | A1 | 12/2010 | Baker et al. | |
| 2010/0299967 | A1 | 12/2010 | Atsumi et al. | |
| 2010/0304346 | A1* | 12/2010 | Morag | 434/258 |
| 2010/0313447 | A1 | 12/2010 | Becker et al. | |
| 2010/0331122 | A1 | 12/2010 | Morag | |
| 2011/0045926 | A1 | 2/2011 | Morag et al. | |
| 2011/0047830 | A1 | 3/2011 | Francello et al. | |
| 2011/0078922 | A1 | 4/2011 | Cavaliere et al. | |
| 2011/0078927 | A1 | 4/2011 | Baker | |
| 2011/0088287 | A1 | 4/2011 | Auger et al. | |
| 2011/0126426 | A1 | 6/2011 | Amark | |
| 2011/0167676 | A1 | 7/2011 | Benz et al. | |
| 2011/0197475 | A1 | 8/2011 | Weidl et al. | |
| 2011/0197478 | A1 | 8/2011 | Baker | |
| 2011/0203136 | A1 | 8/2011 | Auger et al. | |
| 2012/0052987 | A1* | 3/2012 | Goodman | 473/422 |
| 2012/0107781 | A1* | 5/2012 | Morag et al. | 434/247 |
| 2012/0180343 | A1 | 7/2012 | Auger et al. | |
| 2012/0277891 | A1 | 11/2012 | Aragones et al. | |

FOREIGN PATENT DOCUMENTS

| | | |
|---|---|---|
| DE | 1809860 | 4/1960 |
| DE | 2721410 | 11/1978 |
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 0115663 | 8/1984 |
| EP | 115663 | 8/1984 |
| EP | 123550 | 10/1984 |
| EP | 0123550 | 10/1984 |
| EP | 0223700 | 5/1987 |
| EP | 340053 | 11/1989 |
| EP | 0723745 | 7/1996 |
| EP | 1025771 | 8/2000 |
| EP | 1430801 | 6/2004 |
| EP | 1714571 | 10/2006 |
| EP | 1839511 | 10/2007 |
| EP | 2057913 | 5/2009 |
| EP | 2499928 | 9/2012 |
| FR | 1554061 | 1/1969 |
| FR | 2567004 | 1/1986 |
| FR | 2818876 | 7/2002 |
| GB | 1329314 | 9/1973 |
| GB | 2020161 | 11/1979 |
| GB | 2113971 | 8/1983 |
| GB | 2256784 | 12/1992 |
| GB | 2377616 | 1/2003 |
| GB | 2413052 | 10/2005 |
| GB | 2425706 | 11/2006 |
| JP | 9209206 | 8/1997 |
| JP | 9253266 | 9/1997 |
| JP | 10000105 | 1/1998 |
| JP | 10066605 | 3/1998 |
| JP | 63256704 | 10/1998 |
| JP | 11276204 | 10/1999 |
| JP | 2002272506 | 9/2002 |
| JP | 2002306207 | 10/2002 |
| JP | 2004024811 | 1/2004 |
| JP | 2005185303 | 7/2005 |
| JP | 2005304653 | 11/2005 |
| TW | 540323 | 7/2003 |
| TW | 540323 U | 7/2003 |
| TW | M267886 | 6/2005 |
| TW | M267886 U | 6/2005 |
| WO | 0053047 | 9/2000 |
| WO | 03045182 | 6/2003 |
| WO | 03071893 | 9/2003 |
| WO | WO 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | WO 2009011082 | 9/2009 |
| WO | 2010036988 | 4/2010 |
| WO | WO 2010036988 | 4/2010 |
| WO | 2010057207 | 5/2010 |
| WO | 2012150971 | 11/2012 |

OTHER PUBLICATIONS

Invitation to Pay Additional Fees and, Where Applicable, Protest Fee mailed Jan. 8, 2013 in International Application No. PCT/US2012/052970.

Invitation to Pay Additional Fees and, Where Applicable, Protest Fee mailed Jan. 7, 2013 in International Application No. PCT/US2012/052965.

International Search Report and Written Opinion mailed Jan. 22, 2013 in International Application No. PCT/US2012/052972.

Invitation to Pay Additional Fees and, Where Applicable, Protest Fee mailed Feb. 8, 2013 in International Application No. PCT/US2012/052963.

International Search Report and Written Opinion mailed Mar. 15, 2011 in International Application No. PCT/US2010/034821.

International Preliminary Report on Patentability (including Written Opinion of the ISA) mailed Dec. 8, 2011 in International Application No. PCT/US2010/034821.

Invitation to Pay Additional Fees and International Search Report, mailed Nov. 19, 2010 in International Application No. PCT/US2010/036495.

(56) References Cited

OTHER PUBLICATIONS

International Search Report and Written Opinion of the International Searching Authority mailed Jan. 18, 2011 in International Application No. PCT/US2010/036495.
International Preliminary Report on Patentability (including Written Opinion of the ISA) mailed Dec. 8, 2011 in International Application No. PCT/US2010/036495.
Office Action mailed May 23, 2013 in U.S. Appl. No. 12/636,427.
Notice of Allowance mailed Jul. 12, 2013 in U.S. Appl. No. 12/824,753.
Notice of Allowance mailed May 10, 2013 in U.S. Appl. No. 12/916,958.
Pending U.S. Appl. No. 13/561,608, filed Jul. 30, 2012.
Pending U.S. Appl. No. 13/561,557, filed Jul. 30, 2012.
Response to Final Office Action filed on May 10, 2013 in U.S. Appl. No. 12/636,427.
Partial Search Report for PCT/US2009/058522 dated Mar. 4, 2010.
International Search Report for PCT/US2010/050637 dated Jan. 14, 2011.
Pending U.S. Appl. No. 13/234,182, filed Sep. 16, 2011.
Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 13/582,252, filed Oct. 20, 2009.
Pending U.S. Appl. No. 13/234,233, filed Sep. 16, 2011.
Pending U.S. Appl. No. 13/234,180, filed Sep. 16, 2011.
Response to Office Action filed Sep. 12, 2012 in U.S. Appl. No. 12/582,252.
Notice of Allowance mailed Sep. 20, 2012 in U.S. Appl. No. 12/582,252.
U.S. Appl. No. 12/239,190, filed Sep. 26, 2008.
U.S. Appl. No. 12/566,792, filed Sep. 25, 2009.
U.S. Appl. No. 12/711,107, filed Feb. 23, 2010.
U.S. Appl. No. 12/708,411, filed Feb. 18, 2010.
U.S. Appl. No. 12/572,154, filed Oct. 1, 2009.
International Search Report for PCT/US2009/058522 dated Feb. 17, 2010.
International Search Report for PCT/US2010/029640 dated May 17, 2010.
International Search Report and Written Opinion mailed Mar. 8, 2013 in International Application No. PCT/US2012/052965.
International Search Report and Written Opinion mailed Mar. 8, 2013 in International Application No. PCT/US2012/052968.
International Search Report and Written Opinion mailed Mar. 8, 2013 in International Application No. PCT/US2012/052970.
Voluntary Amendments filed Sep. 20, 2012 in Chinese Patent Application No. 201080033231.2 with English-language translation.
Voluntary Amendments filed Nov. 22, 2012 in Chinese Patent Application No. 201080033236.5 with English-language translation.
International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug Web Page (date based on information from Internet Archive).
Dec. 23, 2008, Icebug Web Page (date based on information from Internet Archive).
International Search Report and Written Opinion mailed Jun. 7, 2010 in PCT Application No. PCT/US2009/058522.
International Search Report and Written Opinion mailed May 24, 2010 in PCT Application No. PCT/US2010/029640.
U.S. Appl. No. 12/636,427, filed Dec. 11, 2009.
U.S. Appl. No. 12/824,753, filed Jun. 28, 2010.
International Search Report and Written Opinion for PCT/US2011/045356 dated Dec. 16, 2011.
Office Action mailed Aug. 22, 2012 in U.S. Appl. No. 12/636,427.
Response to Office Action filed Nov. 21, 2012 in U.S. Appl. No. 12/636,427.
Final Office Action mailed Feb. 20, 2013 in U.S. Appl. No. 12/636,427.
Office Action mailed Jan. 22, 2013 in U.S. Appl. No. 12/824,753.
Office Action mailed Dec. 6, 2012 in U.S. Appl. No. 12/916,958.
Response to Office Action filed Mar. 6, 2013 in U.S. Appl. No. 12/916,958.
Office Action mailed Sep. 26, 2012 in U.S. Appl. No. 12/752,318.
Response to Office Action filed Dec. 27, 2012 in U.S. Appl. No. 12/752,318.
Notice of Allowance mailed Feb. 7, 2013 in U.S. Appl. No. 12/752,318.
Voluntary Amendment filed Sep. 20, 2012 in Chinese Application No. 201080033231.2 and English translation thereof.
Voluntary Amendment filed Nov. 22, 2012 in Chinese Application No. 201080033236.5 and English translation thereof.
Response to Office Action filed Apr. 22, 2013 in U.S. Appl. No. 12/824,753.
International Search Report and Written Opinion mailed Jun. 13, 2012 in International Application No. PCT/US2012/021663.
Office Action mailed Jun. 13, 2012 in U.S. Appl. No. 12/582,252.
Pending U.S. Appl. No. 12/582,252, filed Oct. 20, 2009.

* cited by examiner

TRAINING SYSTEM FOR AN ARTICLE OF FOOTWEAR WITH A TRACTION SYSTEM

CROSS REFERENCE TO RELATED APPLICATION

This application is a continuation-in-part of Auger et al., U.S. Pat. No. 8,453,349, (currently U.S. application Ser. No. 12/752,318, entitled "Traction Elements", filed on Apr. 1, 2010) which claims the benefit of U.S. Provisional Application No. 61/166,191, filed on Apr. 2, 2009, both of which are incorporated herein by reference in their entirety.

BACKGROUND

The present invention relates generally to an article of footwear, and in particular to a training system for an article of footwear.

Articles of footwear with traction elements have been previously proposed. Most articles with traction elements are configured for particular field conditions and/or weather conditions. For example, traction elements designed for soft surfaces tend to be longer than traction elements designed for harder surfaces. This creates a difficulty in using the same article with traction elements on both soft and hard surfaces.

SUMMARY

In one aspect, the invention provides a method of training a user wearing an article of footwear, comprising the steps of: providing training instructions to the user; instructing the user to dribble a ball around a plurality of markers; instructing the user to enhance traction with a surface using a traction system; the traction system including an elastic member having a first end fixed relative to an outsole base of the article of footwear and a second end projecting away from the outsole base, the elastic member forming a portion of a traction element configured for ground penetration when the article is used by a wearer of the article; and where the traction system includes an actuating member located within the elastic member and positioned to transfer force from a foot of the wearer to the second end of the elastic member.

In another aspect, the invention provides a method of training a user wearing an article of footwear, comprising the steps of: providing training instructions to the user; instructing the user to dribble a ball around a plurality of markers; instructing the user to enhance traction with a surface using a traction system; the traction system comprising a first traction element having a first portion positioned for ground contact; and the traction system further comprising a base end connected to the first traction element, a center portion extending away from the first traction element across the outsole and having a remote end displaced from the base end, the remote end having a second portion configured for ground contact, and wherein the stabilizer is configured to deflect, in response to forces applied by the user, so as to place the first portion and the second portion into ground contact.

In another aspect, the invention provides a method of using an article of footwear, comprising the steps of: receiving training instructions; dribbling a ball around a plurality of markers, the location of the plurality of markers being determined from the training instructions; using a traction system of the article of footwear to provide traction with a surface, the traction system including an elastic member having a first end fixed relative to an outsole base of the article of footwear and a second end projecting away from the outsole base, the elastic member forming a portion of a traction element configured for ground penetration when the article is used by a wearer of the article; the traction system including an actuating member located within the elastic member, the actuating member being positioned to transfer a force from the foot of the wearer to the second end of the elastic member; and actuating the traction system by applying a force to the actuating member.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
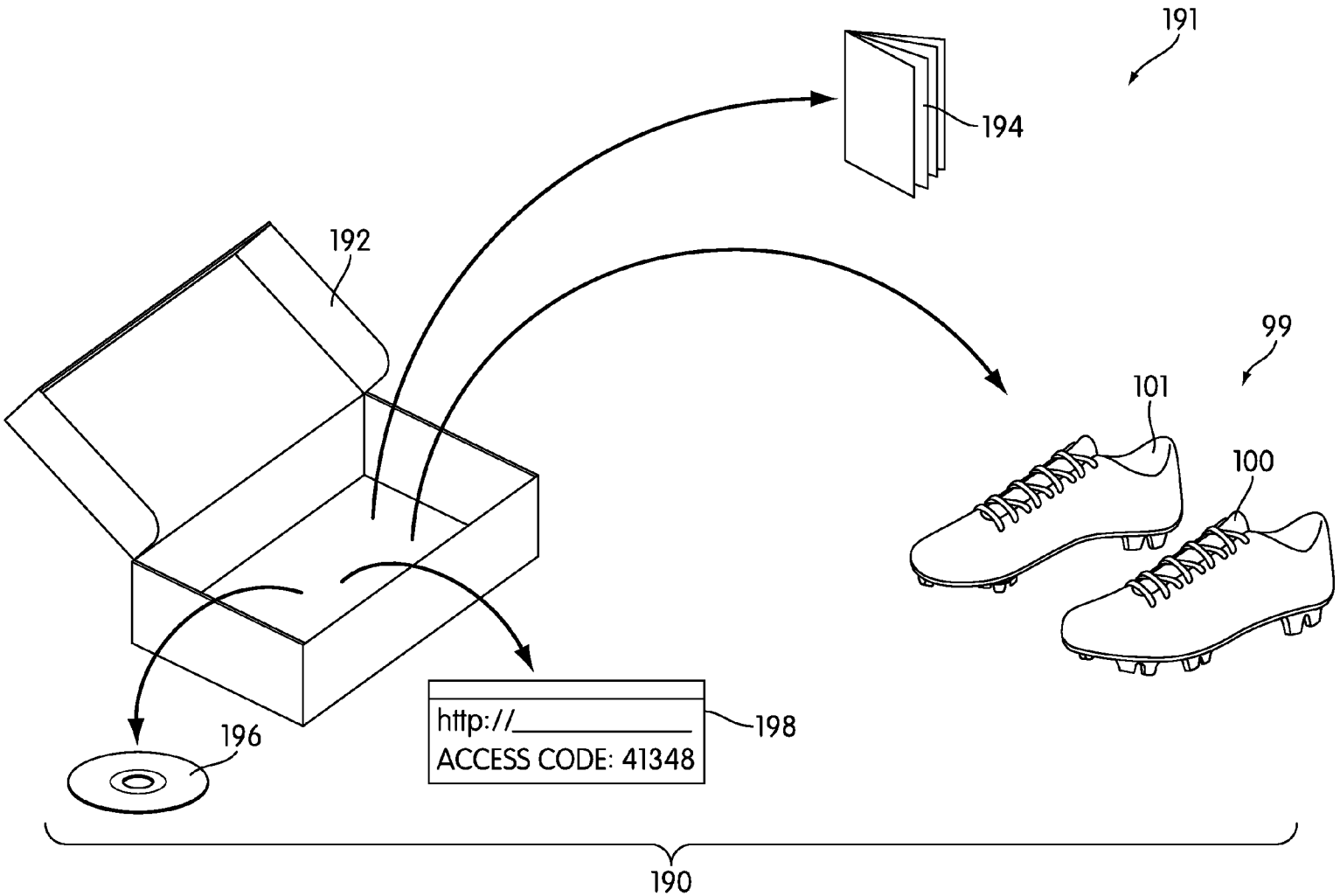
FIG. 1 is a schematic view of an embodiment of a training kit for use in training an athlete to use an article of footwear.

FIG. 1 illustrates an embodiment of training system 191. Training system 191 can be used with any type of footwear. In addition, the principles discussed throughout this detailed description may not be limited in use to footwear. Similar principles could be applied to customization kits for various different types of apparel as well. In an exemplary embodiment, training system 191 may provide a total training solution for an athlete. This total training solution may comprise a combination of footwear and training instructions that are designed to enhance specific athletic skills.

In some embodiments, some components of training system 191 may take the form of training kit 190, also referred to hereafter as kit 190. Kit 190 may comprise one or more items that are packaged together, or otherwise sold or purchased together. It will be understood that in other embodiments, however, components of training system 191 may not be packaged together as a kit but may be sold and/or purchased separately.

In some embodiments, kit 190 may be used by a customer at home. For example, in some cases, a customer could purchase kit 190 at a retail location and bring kit 190 home. In other cases, kit 190 may be shipped to an address associated with the customer. In other embodiments, kit 190 could be used at any other location, such as a retail store or a kiosk.

Kit 190 may include container 192. Container 192 can be any type of container configured to store at least one article of footwear. In some cases, container 192 may be a box. In an exemplary embodiment, container 192 may be a shoebox that is configured to store a pair of footwear.

In one embodiment, kit 190 can include pair of footwear 99. Pair of footwear 99 may further comprise first article of footwear 100 and second article of footwear 101. Generally, articles of footwear associated with kit 190 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 190 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

First article of footwear 100 and second article of footwear 101 may be oriented for a left foot and a right foot, respectively. For purposes of clarity, the following detailed description discusses first article of footwear 100, but it will be understood that each of the features discussed for first article of footwear 100 could also apply to second article of footwear 101. For purposes of convenience, first article of footwear 100 may also be referred to as article 100 throughout the remainder of this detailed description.

Kit 190 can also include provisions for training an athlete to use first article of footwear 100 and second article of footwear 101. The term "athlete" is intended to include both professional athletes and amateur athletes. Generally, an athlete may be any person wishing to take part in an athletic training activity. Any user of pair of footwear 99 may be referred to as an "athlete" throughout this detailed description and in the claims. Furthermore, the terms "athlete" and "user" may be used interchangeably throughout the detailed description and in the claims.

In some embodiments, kit 190 can include provisions for training an athlete to use an article of footwear to accomplish various skills that are important in one or more sports, such as football, soccer, tennis, or any other sport or activity. For example, in embodiments where kit 190 includes a pair of soccer shoes, kit 190 may further include training instructions that may train an athlete to use the pair of soccer shoes to kick, pass, dribble, trap, or perform other maneuvers or skills with a ball. Furthermore, in an exemplary embodiment, kit 190 can include training instructions that may be used by an athlete to learn to use specific features of one or more articles of footwear for accomplishing various skills such as kicking, passing, dribbling, running or making lateral cuts, as well as any other kinds of skills.

In the current embodiment, kit 190 may include one or more sets of training instructions. The term "training instructions" as used throughout this detailed description and in the claims refers to any instructions that can be used to train an athlete or user. Training instructions can be provided as written instructions, pictures, videos, audible instructions as well as any combination thereof.

In different embodiments, training instructions could be provided in different formats. In some cases, training instructions could be provided as paper based or printed instructions. In other cases, training instructions could be provided on various types of removable media. The term "removable media" refers to any media that can be inserted into a media reading device such as a computer, optical media player (including DVD players, CD players and Blu-ray players) or any other type of media reading device. Examples of removable media include, but are not limited to: computer disks, CDs, CD-ROMs, DVDs, Blu-rays discs, HD-DVD discs, removable hard drives, digital memory cards and flash drives as well as any other types of media that can be used with a media reading device.

In the current embodiment, kit 190 may include instruction booklet 194. Instruction booklet 194 may be a set of printed instructions that is packaged with pair of footwear 99 in container 192. In addition, kit 190 may include digital based instructions in the form of removable media 196. Removable media 196 may be inserted into a media reading device, including a computer or dedicated media player, for purposes of accessing training instructions. In an exemplary embodiment, removable media 196 may take the form of a DVD or CD-ROM. In other embodiments, kit 190 could be provided with information for accessing training instructions remotely. For example, in the current embodiment, kit 190 may include card 198. In some cases, card 198 may provide information for remotely accessing one or more sets of training instructions on the web. In particular, in one embodiment, card 198 may include an address for a website as well as any necessary access information such as a user ID and/or user password. In still other embodiments, card 198 could provide a user with information for obtaining one or more software programs that may include training instructions. For example, in one embodiment, card 198 could include information for downloading a software based training application on a computer or mobile device.

It will be understood that some of the provisions included in kit 190 are optional. In particular, in some cases a kit may only include one form of training instructions. Furthermore, in other embodiments training instructions can be provided in any other format.

Figure 2:
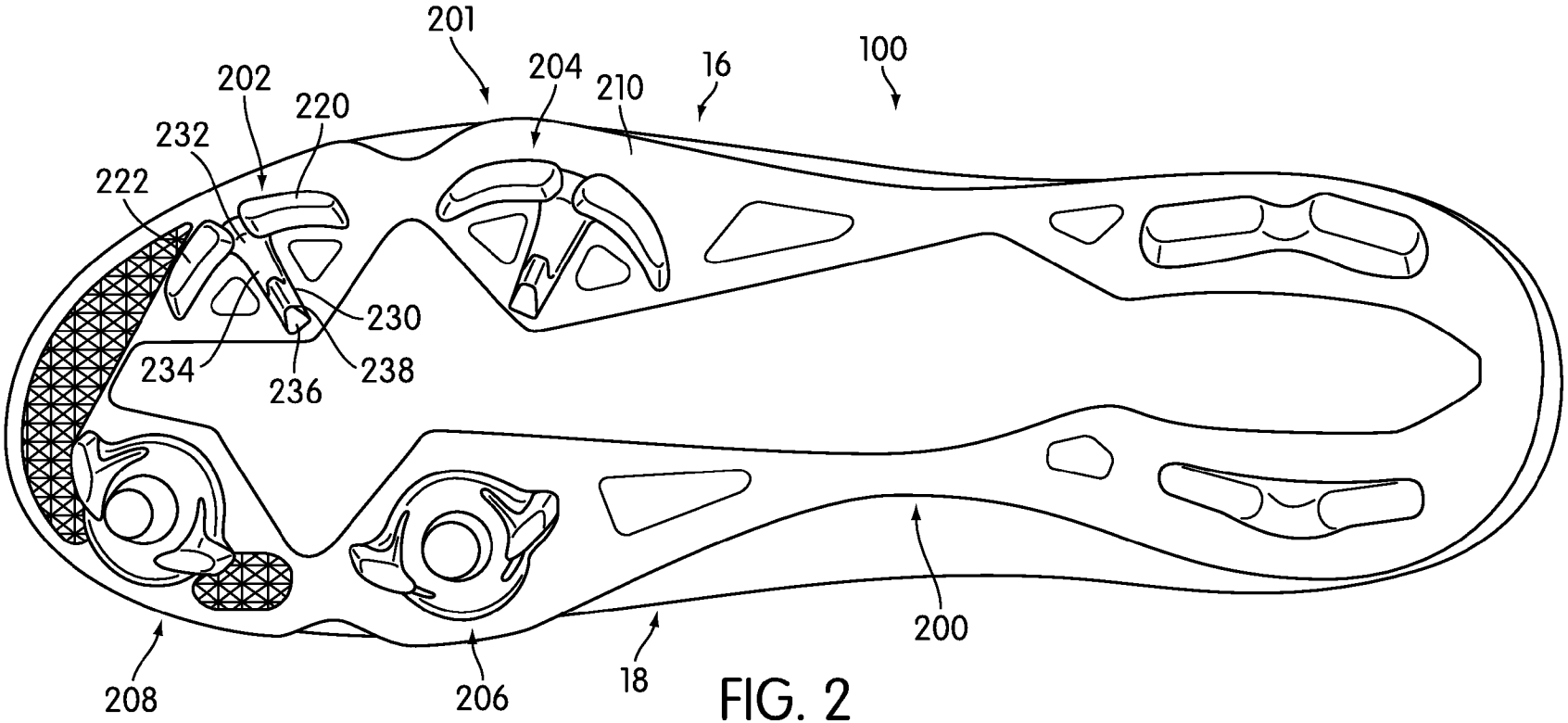
FIG. 2 is a bottom view of an embodiment of an article of footwear associated with a training kit.

FIG. 2 illustrates a bottom view of an embodiment of article 100. Article 100 can include an upper and sole structure 200. Sole structure 200 can include a midsole and/or an outsole. In the current embodiment, sole structure 200 can include base plate 210 that forms a lower surface for sole structure 200.

Article 100 can include traction system 201. Traction system 201 may comprise one or more traction elements that facilitate traction between article 100 and a ground surface. In one embodiment, article 100 includes first traction element 202 and second traction element 204 that are disposed on lateral side 16 of 100. Article 100 also includes third traction element 206 and fourth traction element 208 that are disposed on medial side 18 of article 100.

In the current embodiment, first traction element 202 comprises first portion 220 and second portion 222 that extend outward from base plate 210 and are configured for ground contact. First traction element 202 may be further associated with stabilizer 230. Stabilizer 230 includes base end 232, center portion 234 and remote end 236. Base end 232 may be connected to first traction element 202. Center portion 234 extends away from first traction element 202 so that remote end 236 is displaced from base end 232. Moreover, remote end 236 includes ground contacting portion 238 that is configured to contact a ground surface in some situations.

As discussed in Auger et al., U.S. Pat. No. 8,453,349, (currently U.S. application Ser. No. 12/752,318) referenced above, stabilizer 230 may be configured to deform in some situations. In particular, stabilizer 230 may deflect with base plate 210 to provide foot stabilization during activities that impose dynamic loading. As stabilizer 230 deflects, ground contacting portion 238 may come into contact with a ground surface to provide additional contact points for article 100. In some cases, first portion 220 and second portion 222 may also deform slightly. This arrangement helps to improve stability during lateral cuts or other athletic maneuvers where dynamic loading across article 100 may cause the deflection of sole structure 200 and/or base plate 210.

It will be understood that in some embodiments, second traction element 204 may be substantially similar to first traction element 202. Moreover, second traction element 204 may be associated with a stabilizer element that helps to provide stabilization in some situations. Additional properties and characteristics of traction elements are discussed in further detail in Auger et al., U.S. Pat. No. 8,453,349, (currently U.S. application Ser. No. 12/752,318) referenced above.

Figure 3:
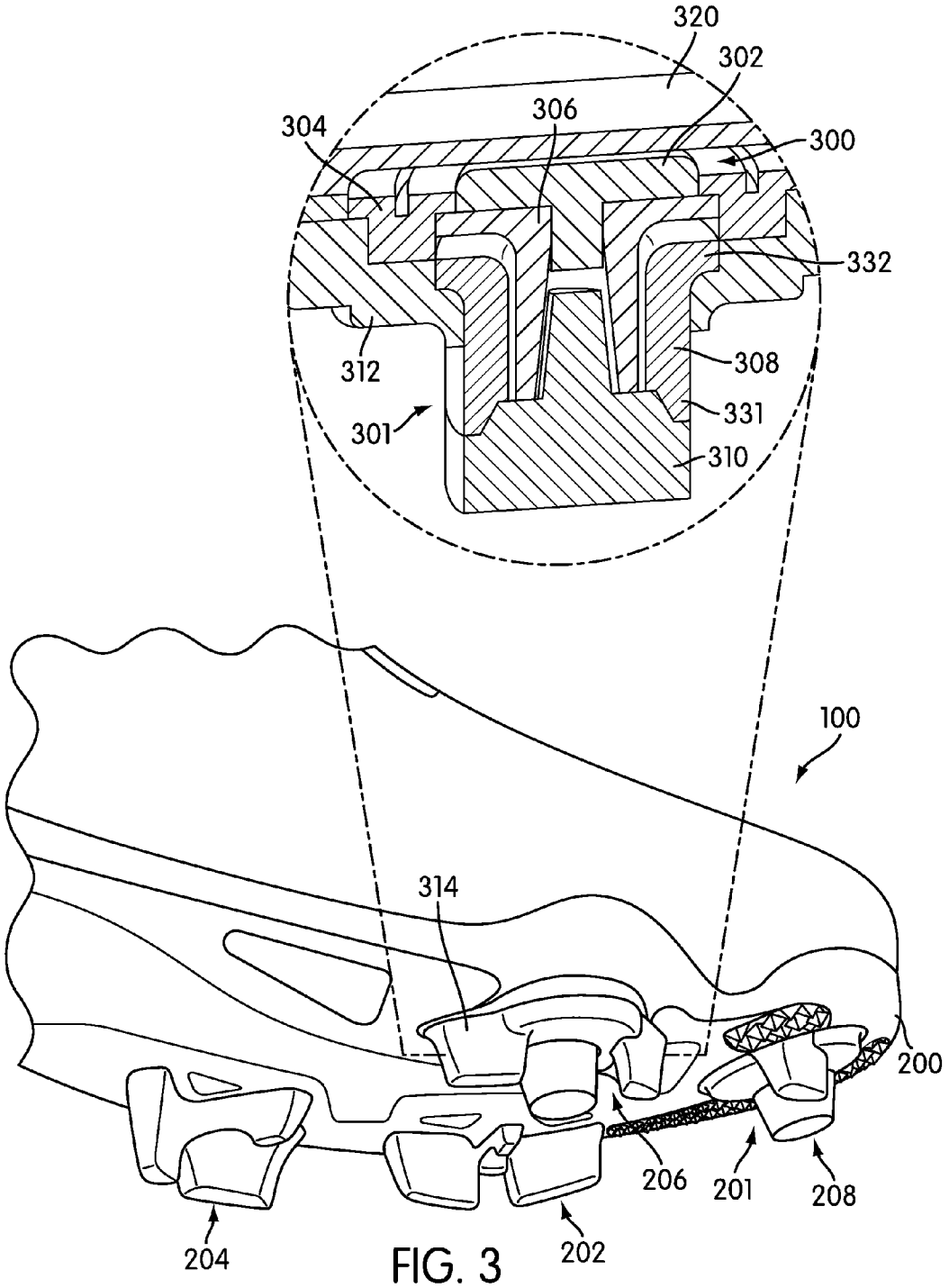
FIG. 3 is an isometric view of an embodiment of an article of footwear associated with a training kit.

FIG. 3 illustrates an isometric view of an embodiment of article 100. Referring to FIG. 3, third traction element 206 and fourth traction element 208 may be extendable and retractable traction elements. Third traction element 206 may include actuator sub-assembly 300 and stud sub-assembly 301. Actuator sub-assembly 300 includes button 302, stopping mechanism (collar) 304 and actuator 306. Stud sub-assembly 301 includes extender 308 and tip 310. Extender 308 is disposed within stud base 312. Extender 308 may be an elastic member including first end 332 and second end 331. In some cases, first end 332 may be attached to stud base 312 and fixed relative to an outsole base of sole structure 200. In addition, second end 331 may extend away from an outsole base of sole structure 200 and may be attached to tip 310. In some cases, stud base 312 may be part of a plastic outsole element that extends over a substantial portion of the outsole. In some embodiments, stud base 312 can include fixed traction portions 314. In addition, in some cases, a lasting board may be disposed between sock liner 320 and stud base 312 and may include an opening over actuator sub-assembly 300.

In some situations, forces transferred from the foot of a user to button 302 may move actuator 306. This causes the extension of extender 308 and results in the extension of tip 310. This arrangement allows third traction element 206 to penetrate further into a ground surface under applied loads by a foot, which can enhance grip with a ground surface. Additional properties and characteristics of traction elements are discussed in further detail in Auger et al., U.S. Pat. No. 8,453,349, (currently U.S. application Ser. No. 12/752,318) referenced above. In particular, various characteristics and arrangements for an actuator sub-assembly and a stud sub-assembly are described in Auger et al., U.S. Pat. No. 8,453,349, (currently U.S. application Ser. No. 12/752,318) referenced above.

It will be understood that the specific arrangement of traction elements shown in FIGS. 2 and 3 are only intended to be exemplary. In other embodiments, any other number of traction elements could be used. In addition, in other embodiments, traction elements could be arranged in any configuration on a sole structure of an article of footwear. Although the current embodiment includes traction elements that are disposed primarily in a forefoot portion of an article of footwear, in other embodiments one or more traction elements could also be disposed on a midfoot portion and/or a heel portion of an article of footwear. In some cases, the specific arrangement and number of traction elements may be selected to facilitate improved stability, speed and agility for a user of the article of footwear.

Figure 4:
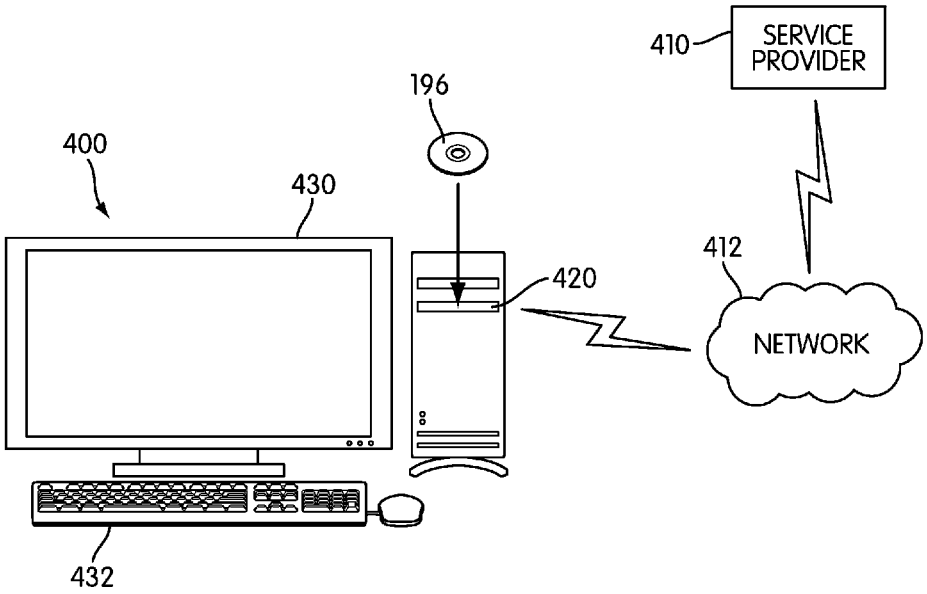
FIG. 4 a schematic view of an embodiment of a computing device that may be used for viewing a set of training instructions.

FIG. 4 illustrates a schematic view of an embodiment of computing device 400. Computing device 400 may be any type of computer, including either a desktop or a laptop computer. In other embodiments, computing device 400 may be any type of device that includes a display and a processor. In some cases, computing device 400 may also include provisions for transmitting and receiving information from a remote network. Examples of such devices include, but are not limited to: PDA's, cell phones, as well as other types of devices.

Computing device 400 can include display device 430 for viewing training instructions. In some cases, computing device 400 can also include input devices 432. In this case, input devices 432 may comprise a keyboard and a mouse.

Computing device 400 may be used to access training instructions stored on electronic media of some kind. For example, in the current embodiment, computing device 400 could be used to access training instructions that may be stored in removable media 196. In this case, computing device 400 may include media drive 420. In addition, computing device 400 may be used to access training instructions that may be stored on other types of media including memory cards, flash drives, as well as any other electronic media device that is capable of being read by a computing device.

In some embodiments, training instructions may be stored at service provider 410. Service provider 410 may be any remote system capable of storing training instructions. In some cases, service provider 410 could comprise one or more servers. In addition, in some cases, training instructions could be stored in the form of content for a website that is hosted by, or in association with, service provider 410. With this arrangement, a user could download training instructions from the website.

Computing device 400 may be configured to access service provider 410 using network 412. Generally, network 412 may be a system allowing for the exchange of information between computing device 400 and service provider 410. Examples of such networks include, but are not limited to: personal area networks, local area networks, wide area networks, client-server networks, peer-to-peer networks, as well as other types of networks. Additionally, the network may support wired transmissions, wireless transmissions, or both wired and wireless transmissions. In some embodiments, network 412 may be a packet-switched communications system. In an exemplary embodiment, network 412 may be the Internet.

Figure 5:
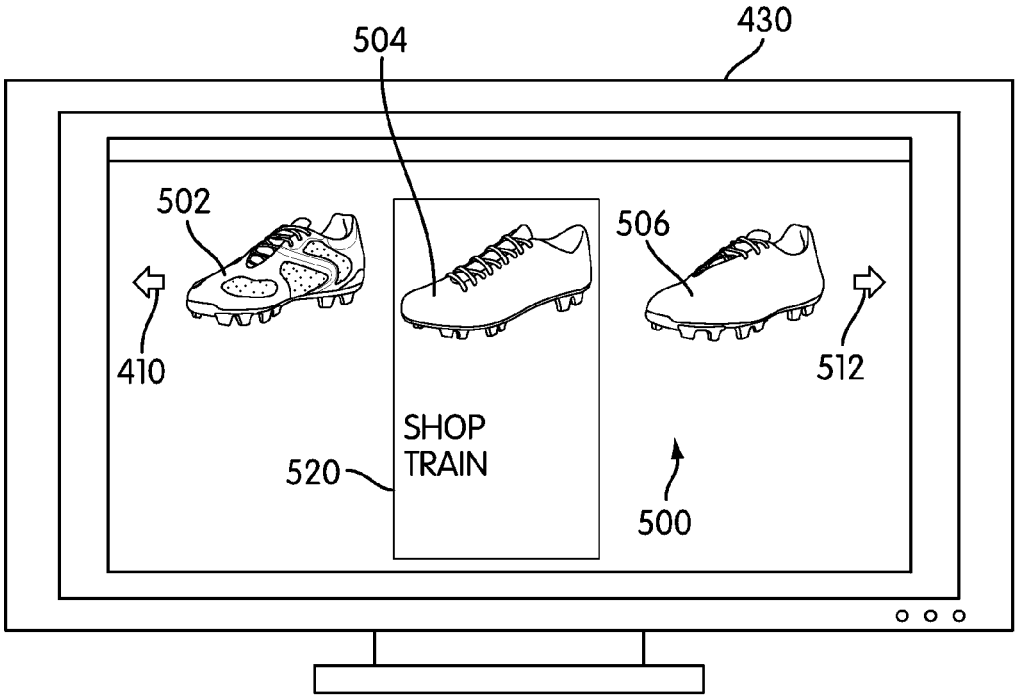
FIG. 5 is a schematic view of an embodiment of a website for viewing a set of training instructions.
Figure 6:
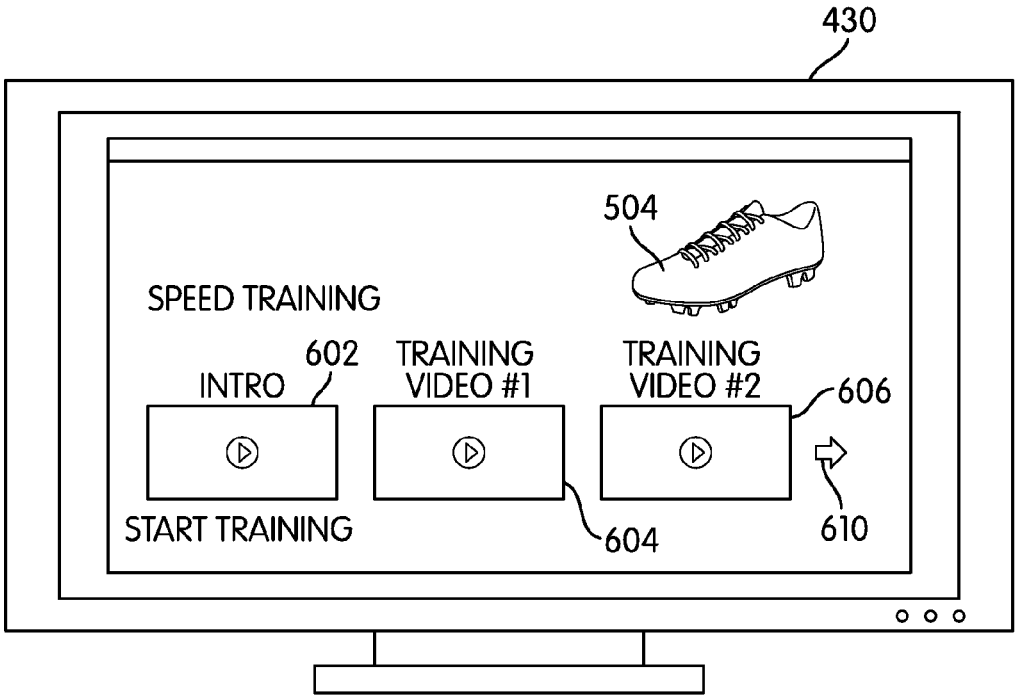
FIG. 6 is a schematic view of an embodiment of a website for viewing a set of training instructions.

FIGS. 5 and 6 illustrate schematic views of an embodiment of a website that provides access to one or more sets of training instructions. It will be understood that the current embodiment is only intended to be exemplary. In other embodiments, a website configured to provide access to one or more sets of training instructions could have any other layout and/or design. Furthermore, in other embodiments, a user could access training instructions through any other type of interface including various types of software interfaces.

Referring to FIG. 5, in some cases, upon visiting a website a user may be prompted to select a particular article of footwear. In the current embodiment, a user has the option of selecting one of three different types of footwear from footwear menu 500. In particular, a user can choose from first article 502, second article 504 and third article 506. In some cases, first article 502, second article 504 and third article 506 may comprise substantially different kinds of footwear. In other cases, first article 502, second article 504 and third article 506 may comprise similar kinds of footwear. In an exemplary embodiment, first article 502, second article 504 and third article 506 may each be articles with different features that help enhance the performance of a user in different skill areas. For example, in some cases, second article 504 could be an article of footwear that helps enhance speed for a user by providing improved traction. Second article 504 could be used with sports such as soccer. In other cases, second article 504 could be used with other sports that require a user to kick a ball accurately. In one embodiment, second article 504 could be substantially similar to first article of footwear 100 that is discussed above. In particular, second article 504 could include a traction system for improving traction and speed.

In addition, in some cases, first article 502 could be an article of footwear that helps enhance ball control during passing and other maneuvers. Furthermore, in some cases, third article 506 could be an article of footwear that helps enhance the accuracy of a kick. Although three articles of footwear are illustrated in the current embodiment, other embodiments could include any other number of footwear. In some cases, a user may choose to view other footwear options by pressing on first menu cursor 510 or second menu cursor 512. This allows a user to scroll through various footwear options.

In some embodiments, each type of footwear that is associated with a predetermined skill set (control, accuracy and speed, for example) may be associated with a particular set of training instructions that are configured to train an athlete in developing the associated skill set. For example, a user could be provided with training instructions for developing ball control using articles of footwear with shape correcting members. Likewise, a user could be provided with training instructions for developing kicking accuracy using articles of footwear including features intended to enhance kicking accuracy. Still further, a user could be provided with training instructions for developing speed using articles of footwear that include traction elements intended to enhance the speed and/or agility of a user.

In some cases, upon selecting an article of footwear from footwear menu 500, a user may be prompted with first drop down menu 520 that includes options to purchase the selected footwear or train using the selected footwear. To obtain access to one or more sets of training instructions, a user may select "train" from drop down menu 520. At this point, a user may be prompted with a set of training instructions in the form of training videos, as seen in FIG. 6. In this case, a user may be prompted to select introduction video 602, training video 604 or training video 606. In addition, a user may select additional training videos by clicking on menu cursor 610.

Generally, training videos could be organized in any manner. In some cases, training videos may be organized by content or type. In other cases training videos may be organized in terms of a timeline for a user to progress from one training video to another. For example, in some cases, training videos could be organized in terms of a weekly progression that has a user viewing different videos, or different combinations of videos, each week. In still other cases, training videos could be organized in any other manner.

Although the current embodiment uses sets of training instructions in the form of training videos, in other embodiments sets of training instructions could take any other format. For example, in other cases, a set of training instructions could be provided on a website as a set of written instructions with diagrams and/or pictures of some kind. In still other cases, a set of training instructions could be provided on a website as an audio file that can be listened to for audibly giving the user instructions. Moreover, in still other embodiments, a set of training instructions could be provided on a website in multiple different formats including videos, audio files, written instructions and/or pictures.

FIGS. 7 through 10 illustrate schematic views of an embodiment of a method of providing training instructions in the form of a training video. In particular, FIGS. 7 through 10 illustrate an embodiment of a training drill that may be used to teach an athlete to run using an article of footwear with a traction system that improves traction on a playing surface and helps to enhance speed and agility. It will be understood that the current embodiment is only intended to be exemplary of one type of drill that could be used to train an athlete. In other embodiments, other types of drills including training instructions could be used.

In the current embodiment, athlete 702 may be provided with articles of footwear. In this case, athlete 702 is wearing first article of footwear 100 and second article of footwear 101, each of which includes a traction system.

Figure 7:
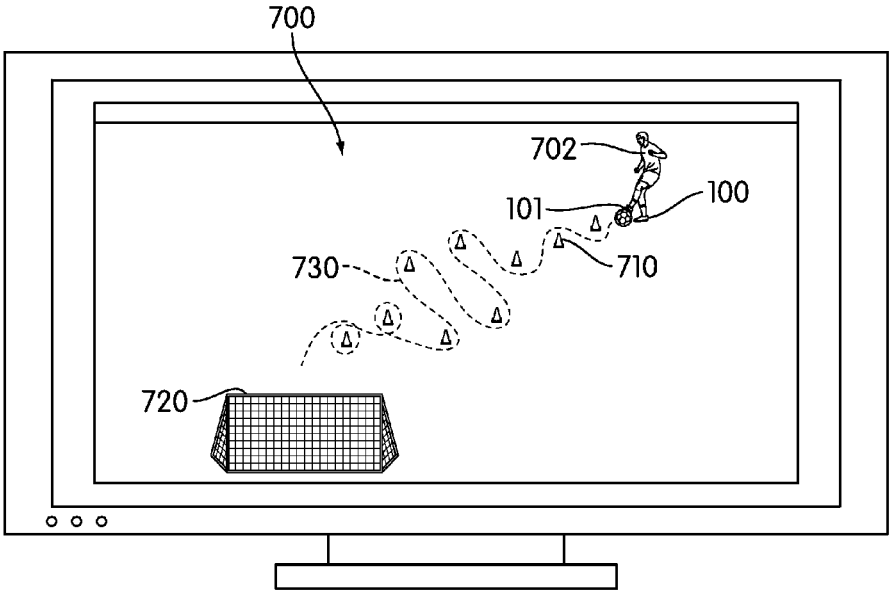
FIG. 7 is a schematic view of an embodiment of a training video for training an athlete to use an article of footwear with a traction system.
Figure 8:
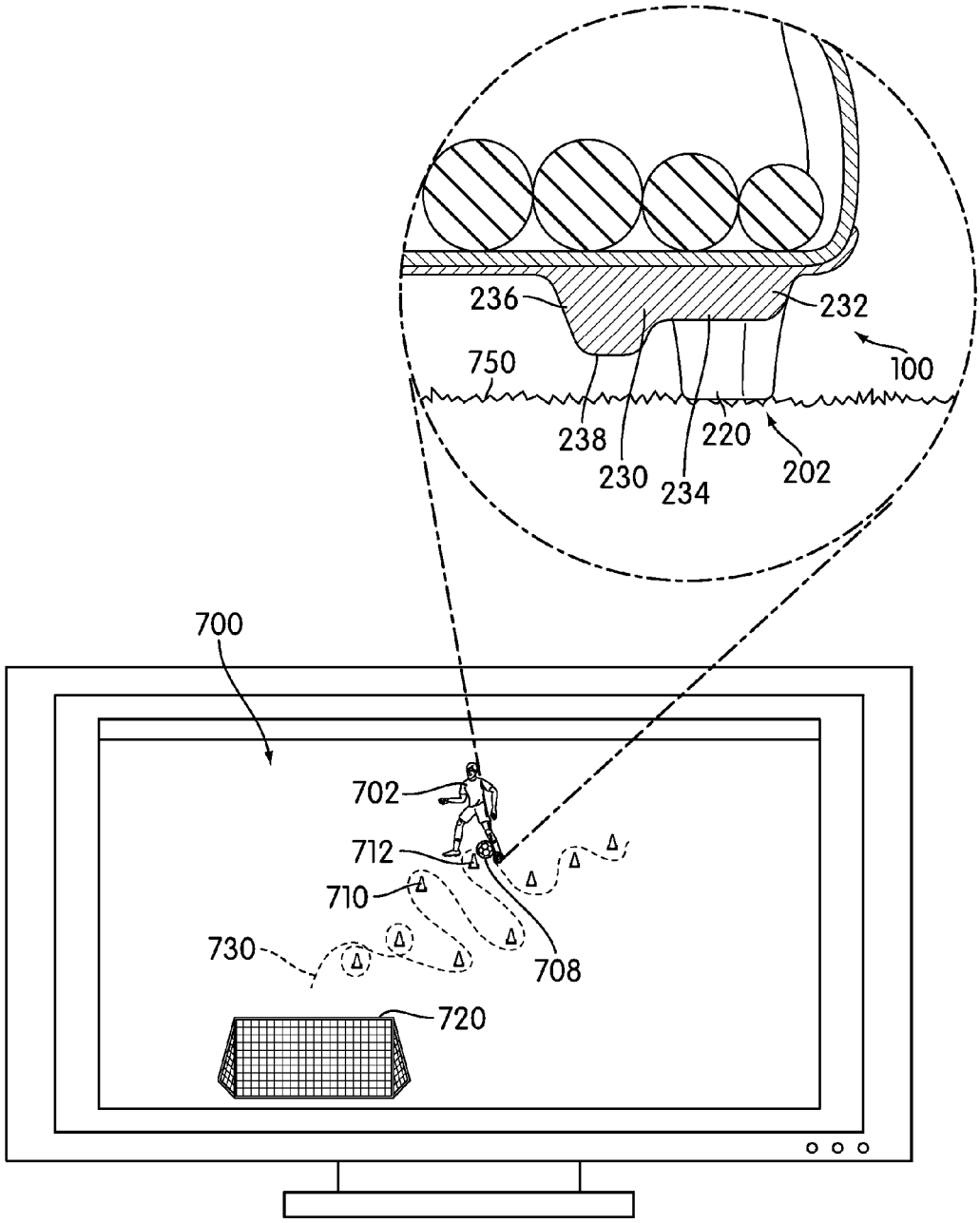
FIG. 8 is a schematic view of an embodiment of a training video for training an athlete to use an article of footwear with a traction system.
Figure 9:
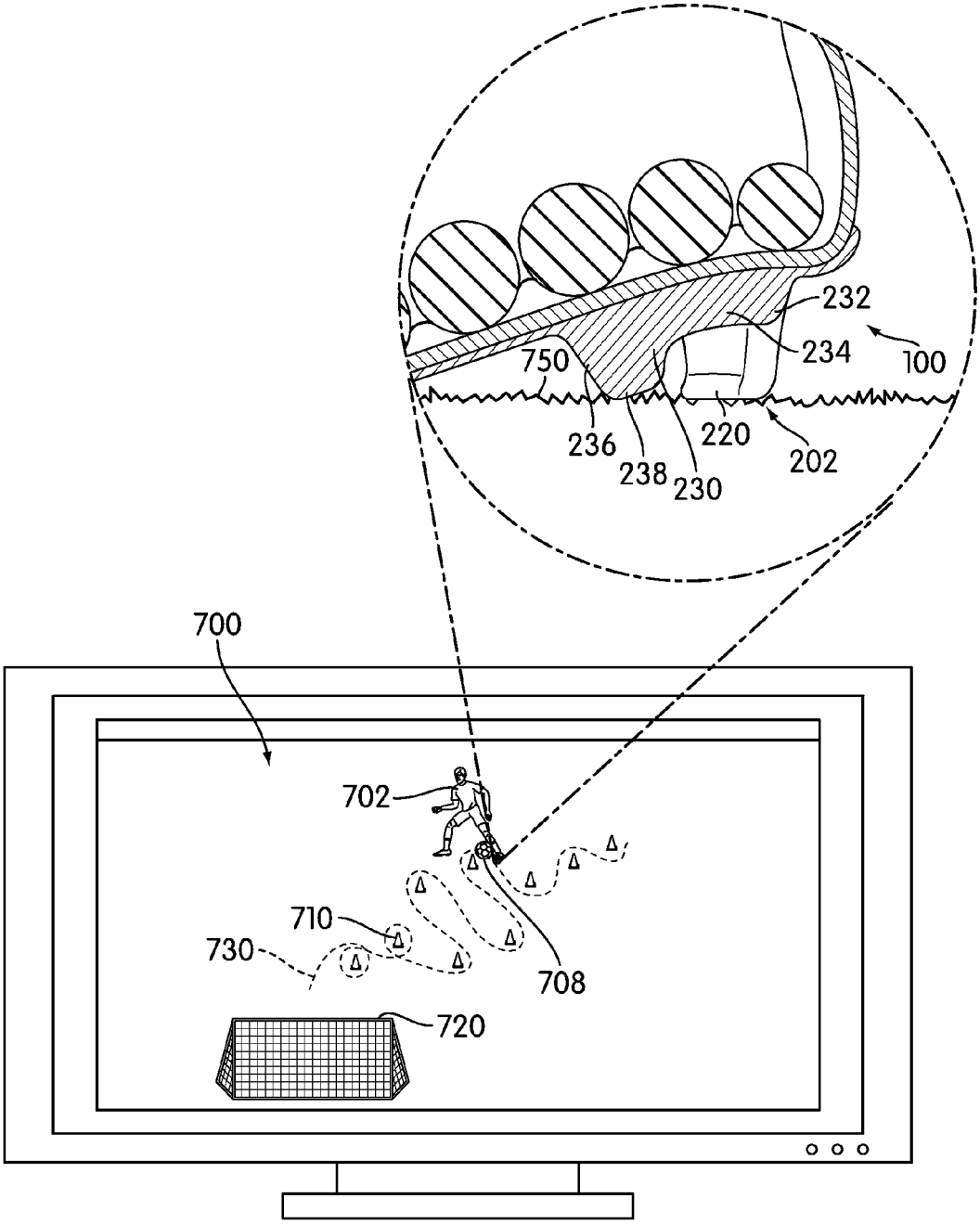
FIG. 9 is a schematic view of an embodiment of a training video for training an athlete to use an article of footwear with a traction system.

Referring to FIGS. 7 through 9, training video 700 may provide instructions for a speed drill that is intended to train a user in a manner that improves speed and agility using articles of footwear with a traction system. Referring to FIG. 7, training video 700 may provide instructions for setting up plurality of markers 710. In some cases, plurality of markers 710 may be cones. In other cases, however, plurality of markers 710 could be any other kinds of markers that identify specific locations on a playing field. In this embodiment, plurality of markers 710 may be set up in a predetermined pattern. Moreover, goal 720 may be located nearby to allow for drills that require an athlete to finish with shots on goal.

Generally, plurality of markers 710 may be arranged in any configuration. In some cases, the configuration of plurality of markers 710 may vary according to the type of training drill. Moreover, some training drills may use one or two markers while other training drills could use three or more markers. In some cases, training video 700 may include instructions for an arrangement of plurality of markers 710. In other cases, however, separate written instructions may be used to determine an arrangement for plurality of markers 710.

Training video 700 may indicate path 730. In some cases, path 730 may be a visual indicator that is superimposed onto a video. Training video 700 may instruct athlete 702 to dribble ball 708 around plurality of markers 710 along path 730. Referring to FIGS. 8 and 9, training video 700 could provide instructions for making lateral cuts as athlete 702 dribbles ball 708 around plurality of markers 710. For example, as athlete 702 dribbles around marker 712, article 100 is put in contact with ground surface 750. Initially, article 100 may be generally level, with first portion 220 of first traction element 202 in contact with ground surface 750. However, as athlete 702 continues to make a lateral cut, athlete 702 may continue pushing outward on lateral side 16 of article 100. In response to these new forces, first portion 220 and second portion 222 (not shown) may deform slightly. In addition, stabilizer 230 of first traction element 202 may be configured to deform so that ground contacting portion 238 is in contact with ground surface 750. This provides multiple point support for article 100 that may help stabilize the foot of athlete 702.

Athlete 702 may continue to dribble ball 708 through plurality of markers 710. At various points along path 730, athlete 702 may be instructed to make lateral cuts in a manner that puts the ground contacting portions of one or more stabilizers in contact with ground surface 750 in order to improve stability. This arrangement may help an athlete learn to use articles of footwear with traction systems to facilitate improved speed and agility.

Figure 10:
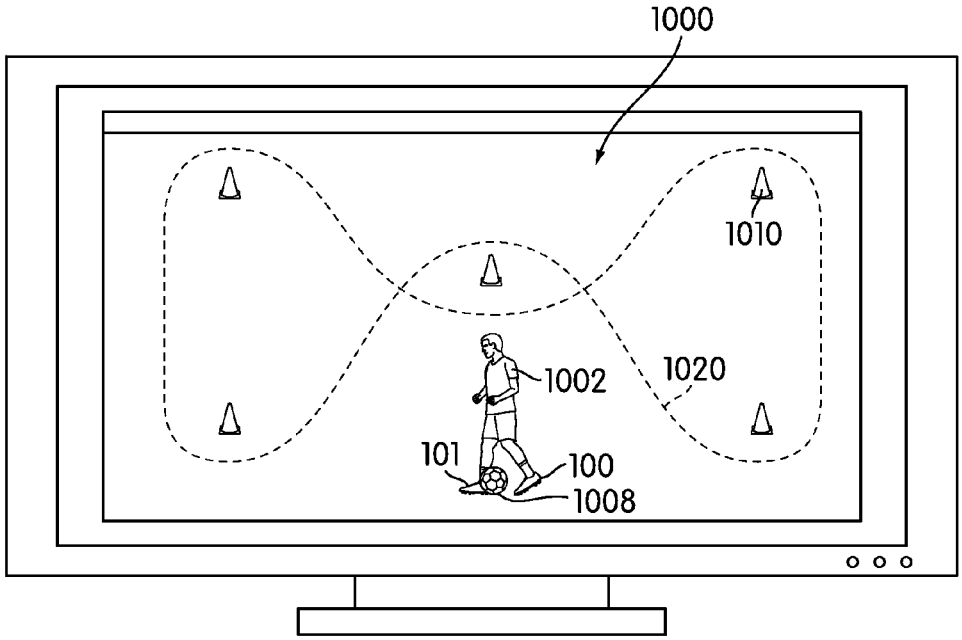
FIG. 10 is a schematic view of an embodiment of a training video for training an athlete to use an article of footwear with a traction system.

FIG. 10 illustrates another embodiment of a training video for training an athlete. Referring to FIG. 10, training video 1000 is intended to provide instructions for an athlete that helps improve speed and agility. In this case, training video 1000 shows plurality of markers 1010 in a square configuration, with a marker at the center of the square configuration. In addition, training video 1000 indicates path 1020 for athlete 1002. In particular, athlete 1002 may be instructed to dribble ball 1008 around plurality of markers 1010 along path 1020. This drill may help train athlete 1002 to use the traction system of article 100 and second article of footwear 101 to improve speed and agility.

Figure 11:
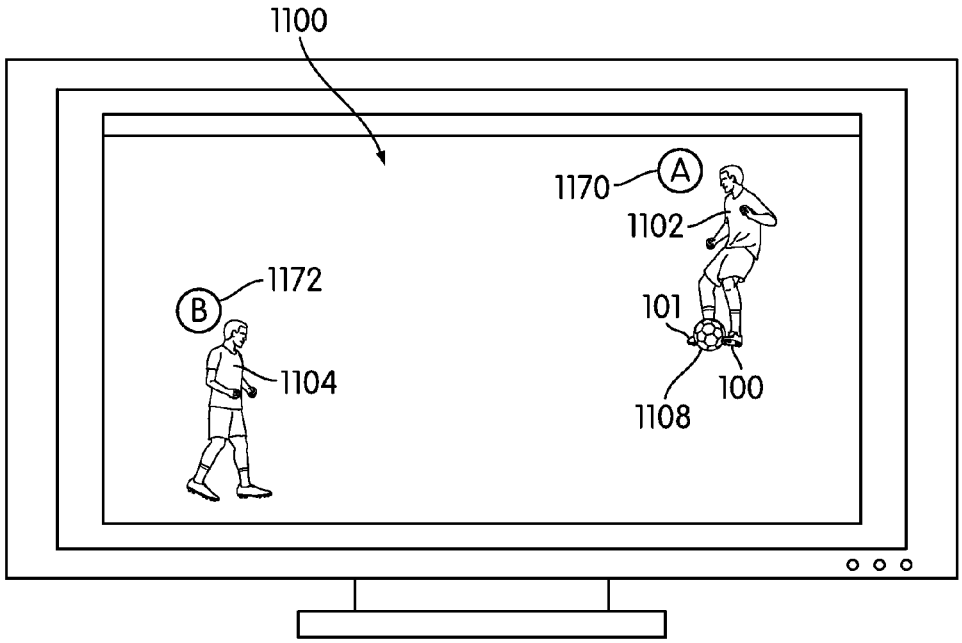
FIG. 11 is a schematic view of an embodiment of a training video for training an athlete to use an article of footwear with a traction system.

FIGS. 11 through 14 illustrate another embodiment of a training video. Referring to FIG. 11, first athlete 1102 and second athlete 1104 are participating in a speed drill. First athlete 1102 may be wearing first article of footwear 100 and second article of footwear 101. In some cases, second athlete 1104 may also be wearing articles of footwear with traction systems similar to those discussed above.

In some embodiments, a training video can include various indicators. For example, in the current embodiment, training video 1100 includes first indicator 1170 for visually indicating the location of first athlete 1102. Likewise, training video 1100 includes second indicator 1172 for visually indicating the location of second athlete 1104. This arrangement may help provide clarity in identifying different athletes as the athletes move across a playing field. In other embodiments, any other indicators could be used for facilitating an explanation of the training instructions.

Figure 12:
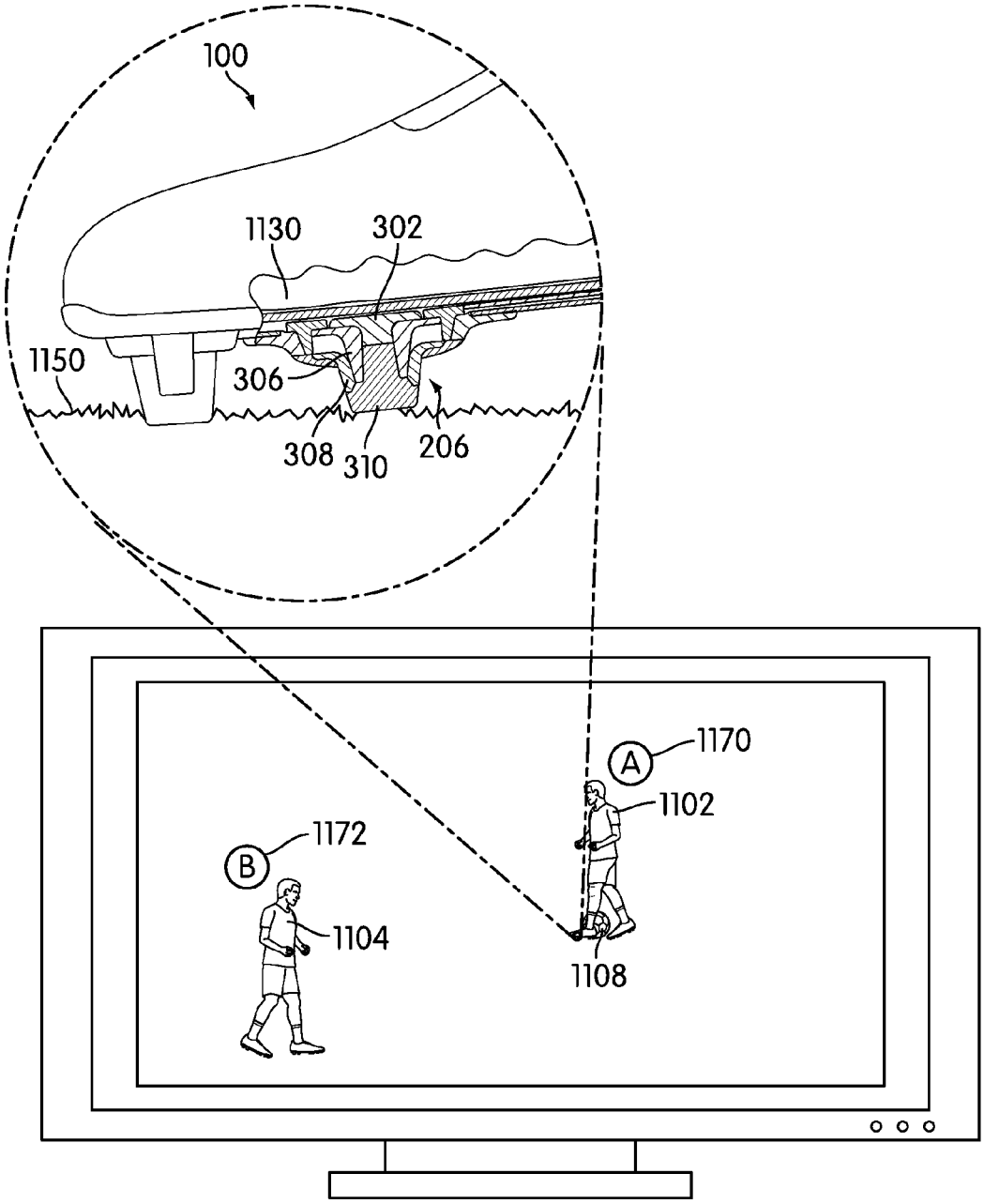
FIG. 12 is a schematic view of an embodiment of a training video for training an athlete to use an article of footwear with a traction system.
Figure 13:
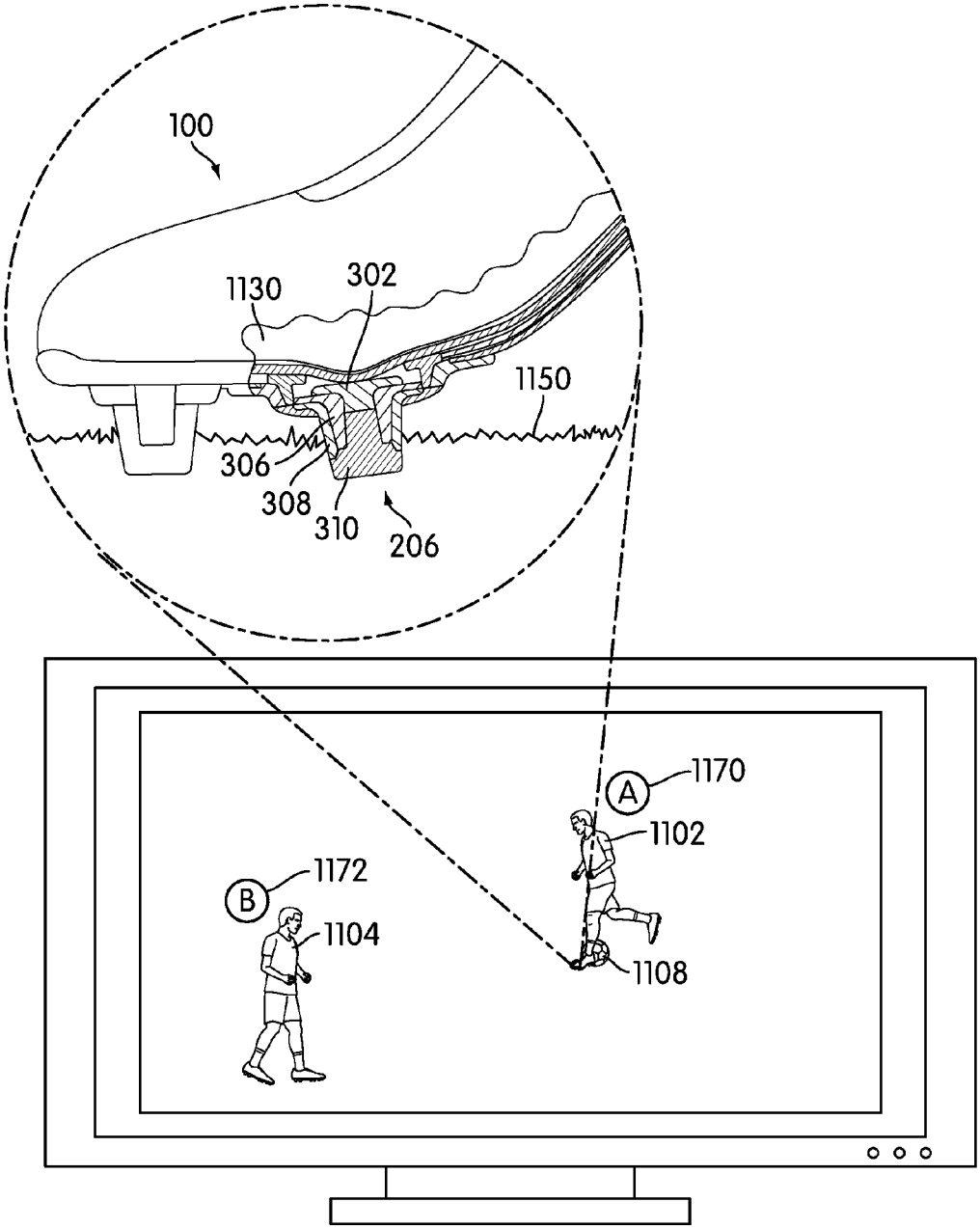
FIG. 13 is a schematic view of an embodiment of a training video for training an athlete to use an article of footwear with a traction system.

Referring to FIGS. 11 through 13, initially first athlete 1102 and second athlete 1104 may be spaced apart from one another. First athlete 1102 starts with ball 1108. First athlete 1102 may be instructed to dribble ball 1108 towards second athlete 1104. As first athlete 1102 runs in a generally forwards direction, third traction element 206 may make contact with ground surface 1150 (see FIG. 12). As foot 1130 is flexed (see FIG. 13), weight is transferred to a front portion of article 100. In particular, foot 1130 may transfer a force to button 302 of third traction element 206. This downward force may apply forces to actuator 306. As actuator 306 is moved, actuator 306 pushes downwardly on extender 308. This acts to extend tip 310, which penetrates further into ground surface 1150. The arrangement provides enhanced traction with ground surface 1150 to help improve stability and enhance speed and agility.

Although the current embodiment illustrates the extension of third traction element 206, it will be understood that in some cases, fourth traction element 208 may also extend in a similar manner to third traction element 206 under forces transferred from a foot to fourth traction element 208. Moreover, in embodiments incorporating more than two extendable traction elements, forces from a foot may be transferred to two or more traction elements to facilitate extension of the traction elements.

Figure 14:
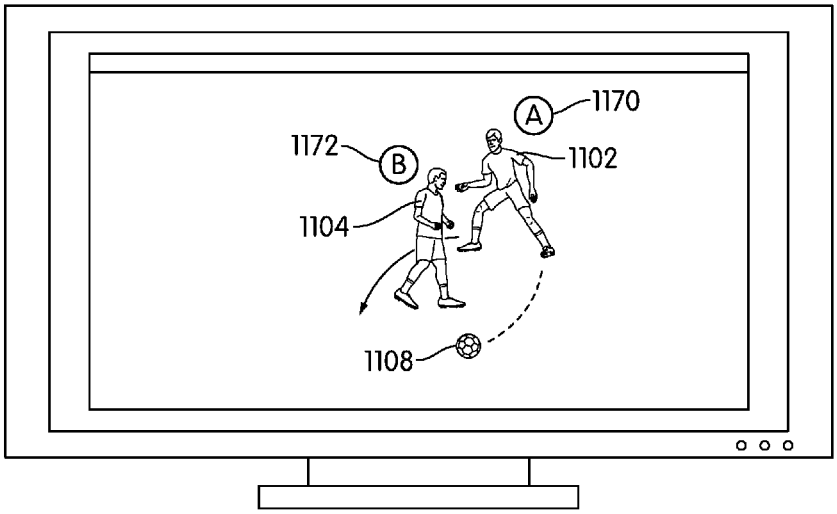
FIG. 14 is a schematic view of an embodiment of a training video for training an athlete to use an article of footwear with a traction system.

Referring to FIG. 14, as first athlete 1102 nears second athlete 1104, first athlete 1102 is instructed to pass ball 1108 around second athlete 1104 on a first side of second athlete 1104, while simultaneously running around a second side of athlete 1104 to receive ball 1108. This allows first athlete 1102 to get past second athlete 1104 without having ball 1108 stolen.

As mentioned, the current embodiment is only intended to be exemplary. In other embodiments, the training drill described here could be modified in any other manner. For example, in another embodiment an accuracy training drill may include instructions for three or more athletes. In another embodiment, an accuracy training drill could include instructions for a single athlete.

Figure 15:
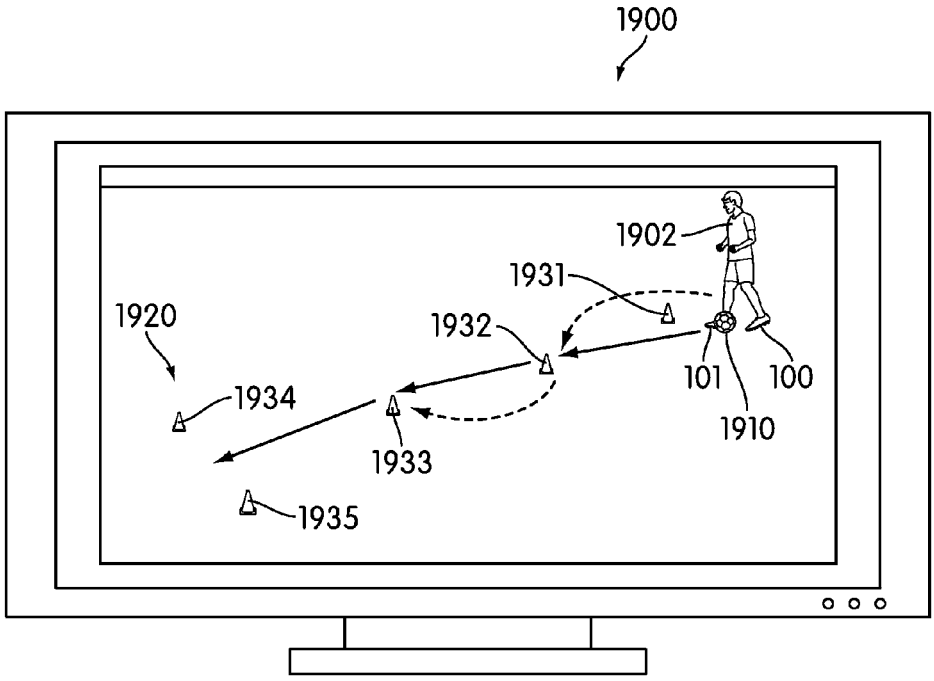
FIG. 15 is a schematic view of an embodiment of a training video for training an athlete to improve first step acceleration.
Figure 16:
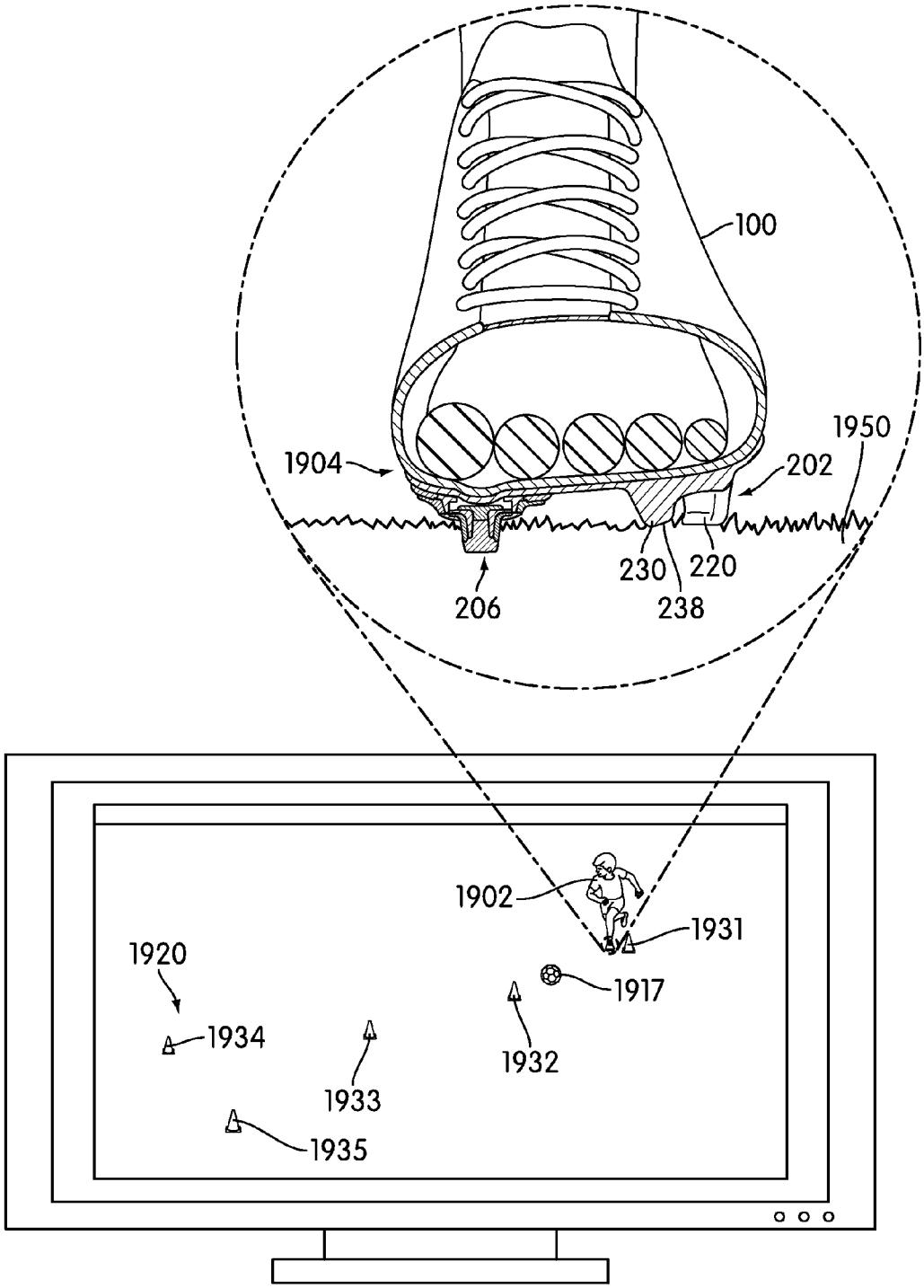
FIG. 16 is a schematic view of an embodiment of a training video for training an athlete to improve first step acceleration.

A training program can include provisions for instructing a user to improve first step acceleration. FIGS. 15 and 16 illustrate another embodiment of training video 1900 that provides training instructions in the form of a practice drill. Referring to FIG. 15, athlete 1902 may be wearing first article of footwear 100 and second article of footwear 101. Moreover, athlete 1902 is shown on a practice field with ball 1910 and plurality of markers 1920. In some cases, plurality of markers 1920 may be cones. In other cases, plurality of markers 1920 may be any other kinds of markers. Moreover, the arrangement of plurality of markers 1920 can vary in different embodiments according to the particular type of drill.

In some cases, training video 1900 provides instructions for a training drill that may help improve the first step of a user, which can enhance overall speed. For purposes of illustration, the intended path of the ball is indicated with solid arrows, while the intended path of the athlete is indicated with dotted arrows. In particular, training video 1900 instructs a user to make a back heel pass with ball 1910 around marker 1931. Immediately following the back heel pass, a user is instructed to turn and accelerate onto ball 1910 using a first step. The user is then instructed to control ball 1910 at speed and flick ball 1910 around marker 1932. Finally, a user may catch up to ball 1910 at marker 1933 and stop ball 1910 at a finishing line, which is identified by marker 1934 and marker 1935. In an exemplary embodiment, athlete 1902 may demonstrate this drill in training video 1900.

FIG. 16 illustrates an embodiment of athlete 1902 during a first step of the drill. Referring to FIG. 16, to provide maximum acceleration onto ball 1910, athlete 1902 may plant article 100 into ground surface 1950. In some embodiments, one or more traction elements may engage ground surface 1950 to increase traction and provide better acceleration. In the exemplary embodiment, for example, third traction element 206 may be engaged with ground surface 1950. In particular, as athlete 1902 pushes off at medial portion 1904 of article 100, weight is transferred to a front portion of article 100 in a manner that further extends third traction element 206 into ground surface 1950. In some cases, fourth traction element 208 (see FIG. 2) may provide additional traction in a similar manner as athlete 1902 pushes off at medial portion 1904 of article 100. Additionally, as athlete 1902 pushes off from medial portion 1904, first portion 220 and stabilizer 230 of first traction element 202 may be configured to deform so that ground contacting portion 238 is in contact with ground surface 1950. In some cases, second traction element 204 (see FIG. 2) may also deflect to provide additional stability. With this arrangement, third traction element 206 and fourth traction element 208 can help provide increased traction during first step acceleration while first traction element 202 and second traction element 204 increase stability. By practicing the drill shown in training video 1900, a user may improve first step acceleration, which can enhance overall speed and lateral quickness.

In addition to providing visual instructions, a training system may be configured to provide additional training information. For example, in some cases, a training system could provide information related to the number of repetitions of a drill that is shown in a training video. In an exemplary embodiment, an athlete may be provided with a worksheet that indicates the desired number of repetitions of a drill for a particular day of a training schedule.

The previous embodiments are intended to be exemplary of the different types of training instructions that can be provided to athletes for the purposes of improving speed and/or agility using articles of footwear with traction systems. In still other embodiments, other types of drills could be used and shown in training videos. In other embodiments, training drills may incorporate passing as well as running with a ball. Moreover, each of these different types of training drills or training videos may incorporate training instructions that are intended to teach an athlete to perform speed and/or agility moves using an article of footwear with a traction system.

In some embodiments, a training system may be implemented using a mobile device. In some cases, training instructions can be provided on a web browser operating on the mobile device. In other cases, training instructions can be provided using one or more applications that are configured to run on the mobile device. In still other cases, training instructions can be provided using any combination of web browsers and dedicated applications running on a mobile device.

Figure 17:
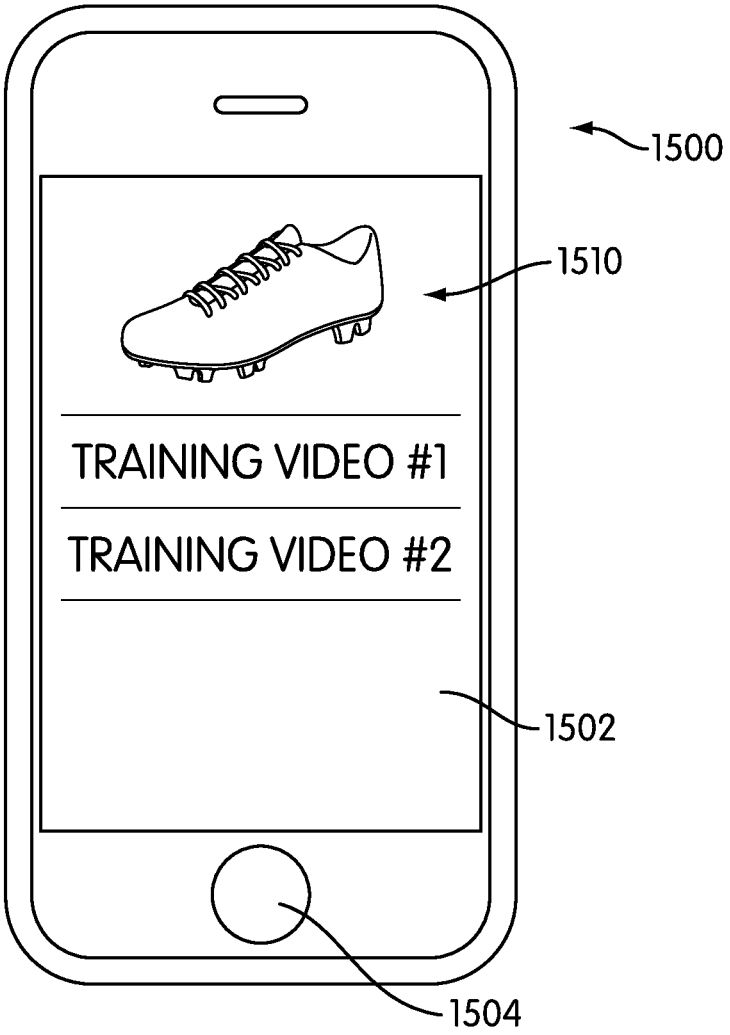
FIG. 17 is a schematic view of a portable computing device that may be used for viewing a training video.

FIG. 17 illustrates a schematic view of an embodiment of a training system that utilizes one or more features of mobile device 1500. Generally, a mobile device could be any device that is portable and that may be used by an athlete or user to obtain training instructions. Examples of different mobile devices include, but are not limited to: mobile phones, digital music players, portable digital assistants (PDAs), portable gaming machines, ultraportable laptops as well as any other kinds of mobile devices. In the exemplary embodiment, mobile device 1500 may be an iPhone or iPod manufactured by Apple Computer, Inc.

Mobile device 1500 can be configured with display screen 1502. Also, mobile device 1500 can include input button 1504. Furthermore, in some cases, mobile device 1500 can be configured with a touch-sensitive screen. In other cases, mobile device 1500 can include any other input devices. It will be understood that mobile device 1500 can include various other provisions including speakers, a microphone, ports for syncing and/or powering mobile device 1500, a headphone jack as well as various other provisions which are not visible in FIG. 15.

Mobile device 1500 can be configured to run one or more software applications. In some cases, software applications can be provided on mobile device 1500 at the time of manufacturing. In other cases, software applications can be downloaded from a service provider. In one exemplary embodiment, a user may purchase an application from an online retail store such as iTunes.

Mobile device 1500 may be configured to run training application 1510. In some cases, training application 1510 may be a software application that provides a user with various training videos including any of the videos that are accessible in the website described above. In some cases, upon loading training application 1510, a user may be prompted to select the desired training video.

In some embodiments, a training application may be designed for a particular type of footwear. For example, in the current embodiment, training application 1510 may be designed to provide training instructions for training an athlete in a manner that improves speed and agility using articles of footwear with traction systems. In other embodiments, a training application could be configured with training instructions for multiple different kinds of footwear. In such cases, upon loading the training application, a user could be prompted to select the desired type of footwear for training.

Figure 18:
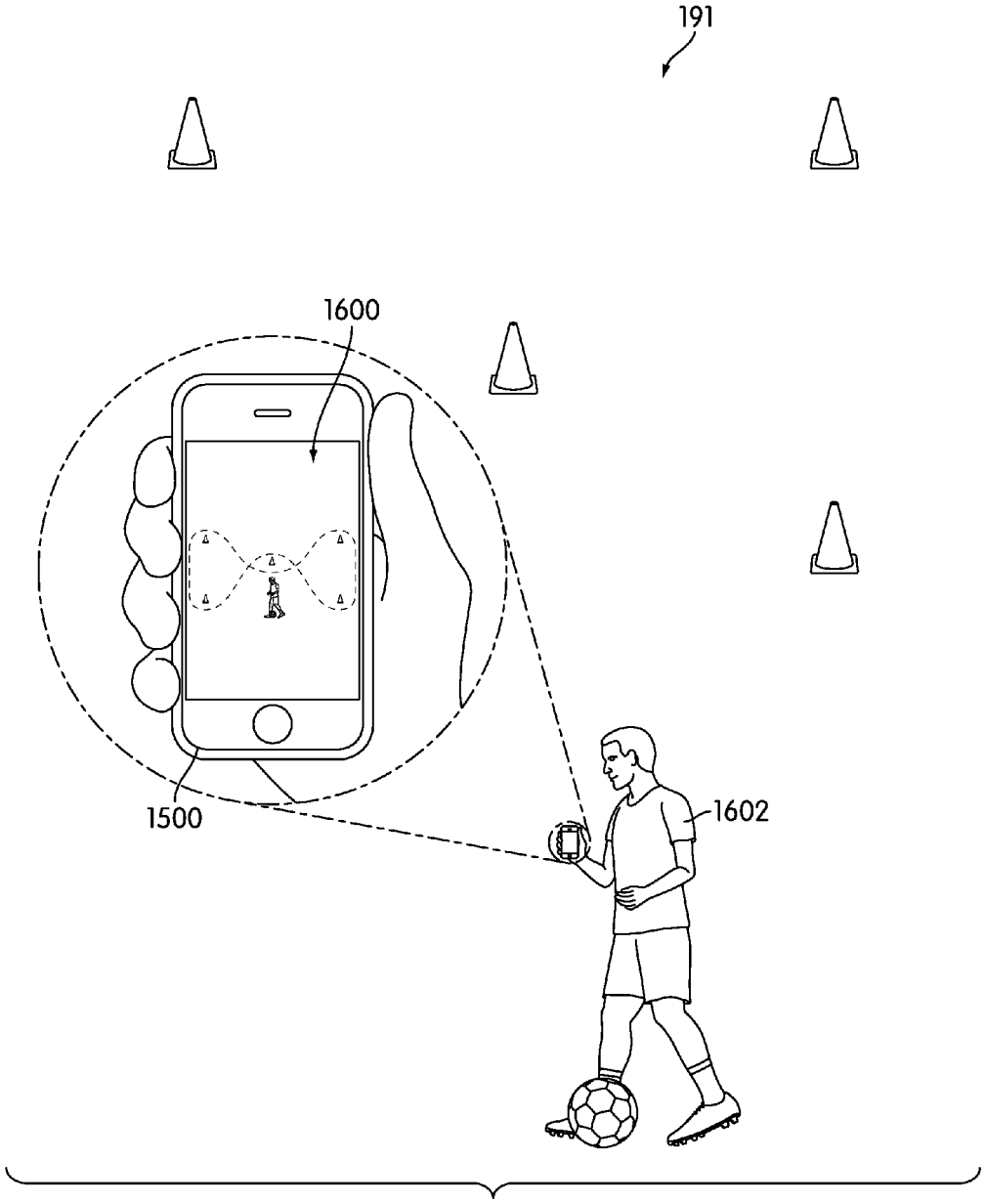
FIG. 18 is a schematic view of an embodiment of an athlete using a portable computing device during training.

FIG. 18 illustrates an embodiment of training system 191 incorporating the use of mobile device 1500. In this case, athlete 1602 is able to view training video 1600 on mobile device 1500. This allows athlete 1602 to receive training instructions while participating in a training activity. Although the current embodiment illustrates athlete 1602 holding mobile device 1500 during a training exercise, in other embodiments athlete 1602 may not hold mobile device 1500 during the training exercise. With this arrangement, athlete 1602 is able to receive training instructions in various different situations.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of using an article of footwear, comprising the steps of:

receiving training instructions;

in accordance with the training instructions, dribbling a ball around a plurality of markers and enhancing traction with a surface using a traction system;

the traction system including an elastic member having a first end fixed relative to an outsole base of the article of footwear and a second end projecting away from the outsole base, the elastic member forming a portion of a traction element configured for ground penetration when the article is used by a wearer of the article; and wherein the traction system includes an actuating member located within the elastic member and positioned to transfer force from a foot of the wearer to the second end of the elastic member;

the article of footwear further including an interior region within an upper of the article of footwear and above the outsole base;

wherein the traction system includes a button positioned on the actuating member between the actuating member and the interior region, wherein the button is constrained from translational movement relative to the actuating member but can rotate relative to the actuating member.

2. The method according to claim 1, wherein the training instructions are provided in a written format.

3. The method according to claim 1, wherein the training instructions are provided in a video format.

4. The method according to claim 1, wherein the training instructions are provided in an audible format.

5. The method according to claim 1, wherein the training instructions are provided in a training kit, the training kit including the article of footwear.

6. The method according to claim 1, wherein the training instructions provide instructions for training multiple athletes simultaneously.

7. A method of using an article of footwear, comprising the steps of:

receiving training instructions;

in accordance with the training instructions, dribbling a ball around a plurality of markers and enhancing traction with a surface using a traction system;

the traction system comprising a first traction element having a first portion positioned for ground contact on an exposed underside of a sole structure of the article of footwear; and the traction system further comprising a stabilizer having a base end connected to the first traction element, a center portion extending away from the first traction element across the outsole and having a remote end displaced from the base end, the remote end having a second portion configured for ground contact, and wherein the stabilizer is configured to deflect, in response to forces applied by the user, so as to place the first portion of the first traction element and the second portion of the stabilizer into ground contact;

wherein the center portion has an exposed surface generally parallel to the second portion of the remote end of the stabilizer; and wherein a distance between the exposed surface of the center portion and the exposed underside of the sole structure is less than a distance between the second portion of the remote end of the stabilizer and the exposed underside of the sole structure.

8. The method according to claim 7, wherein the training instructions are provided on removable media.

9. The method according to claim 7, wherein the training instructions are provided in an instruction booklet.

10. The method according to claim 7, wherein the training instructions are provided on a website.

11. The method according to claim 7, wherein the training instructions are provided in a software application.

12. The method according to claim 7, wherein the training instructions are configured to be accessed on a computer.

13. The method according to claim 7, wherein the training instructions are configured to be accessed on a mobile device.

14. A method of using an article of footwear, comprising the steps of:

receiving training instructions;

in accordance with the training instructions, dribbling a ball around a plurality of markers, the location of the plurality of markers being determined from the training instructions, and using a traction system of the article of footwear to provide traction with a surface, the traction system including an elastic member having a first end fixed relative to an outsole base of the article of footwear and a second end projecting away from the outsole base, the elastic member forming a portion of a traction element configured for ground penetration when the article is used by a wearer of the article;

the traction system including an actuating member located within the elastic member, the actuating member being positioned to transfer a force from the foot of the wearer to the second end of the elastic member; and actuating the traction system by applying a force to the actuating member;

the article of footwear further including an interior region within an upper of the article of footwear and above the outsole base;

wherein the traction system includes a button positioned on the actuating member between the actuating member and the interior region, wherein the button is constrained from translational movement relative to the actuating member but can rotate relative to the actuating member.

15. The method according to claim 14, wherein the training instructions and the article of footwear are received in a training kit.

16. The method according to claim 14, wherein the method includes a step of using a computing device to read digital information related to the training instructions.

17. The method according to claim 14, wherein the method includes a step of receiving the training instructions from a website.

18. The method according to claim 14, wherein the method includes a step of reading an instruction booklet that includes the training instructions.

19. The method according to claim 14, wherein the method includes a step of downloading a training application onto a mobile device, the training application including information about the training instructions.

20. The method according to claim 14, wherein the method includes a step of watching a training video, the training video including information about the training instructions.

* * * * *